US009378668B2

(12) United States Patent
Han

(10) Patent No.: US 9,378,668 B2
(45) Date of Patent: Jun. 28, 2016

(54) PIXEL, DISPLAY DEVICE INCLUDING THE PIXEL, AND DRIVING METHOD OF THE DISPLAY DEVICE

(75) Inventor: Sang-Myeon Han, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 199 days.

(21) Appl. No.: 13/398,755

(22) Filed: Feb. 16, 2012

(65) Prior Publication Data

US 2012/0306840 A1 Dec. 6, 2012

(30) Foreign Application Priority Data

May 31, 2011 (KR) ..... 10-2011-0052357

(51) Int. Cl.
*G09G 3/00* (2006.01)
*G09G 3/32* (2016.01)

(52) U.S. Cl.
CPC ..... *G09G 3/003* (2013.01); *G09G 3/3233* (2013.01); *G09G 2300/0852* (2013.01); *G09G 2300/0861* (2013.01); *G09G 2310/0216* (2013.01); *G09G 2310/062* (2013.01); *G09G 2320/0223* (2013.01); *G09G 2320/0261* (2013.01); *G09G 2320/0266* (2013.01); *G09G 2320/045* (2013.01)

(58) Field of Classification Search
CPC ..... G09G 2300/0852; G09G 2300/0861; G09G 2310/0216; G09G 2310/062; G09G 2320/0223; G09G 2320/0261; G09G 2320/0266; G09G 2320/045; G09G 3/003; G09G 3/3233
USPC ..... 345/212
See application file for complete search history.

(56) References Cited

U.S. PATENT DOCUMENTS 6,919,871 B2 * 7/2005 Kwon ..... G09G 3/325 345/90
7,193,588 B2 * 3/2007 Lo ..... G09G 3/3233 315/169.1
7,545,354 B2 * 6/2009 Ha ..... G09G 3/3233 345/83
7,646,366 B2 * 1/2010 Ha ..... G09G 3/3233 345/82
7,817,120 B2 * 10/2010 Peng ..... G09G 3/3233 315/169.3
7,843,442 B2 * 11/2010 Choi ..... G09G 3/3233 327/94

(Continued)

FOREIGN PATENT DOCUMENTS

KR 10-2003-0032530 4/2003
KR 10-2008-0090954 10/2008

(Continued)

*Primary Examiner* — Temesgh Ghebretinsae
*Assistant Examiner* — Michael J Jansen, II
(74) *Attorney, Agent, or Firm* — Lewis Roca Rothgerber Christie LLP

(57) ABSTRACT

A pixel, a display device including the same, and a driving method thereof. After the anode voltage of an organic light emitting diode (OLED) is discharged and reset, a first voltage corresponding to a data voltage applied to a storage capacitor is transmitted to a compensation capacitor. A voltage corresponding to the threshold voltage of the driving transistor is transmitted to the compensation capacitor. The data voltage is stored according to a data signal corresponding to the storage capacitor. The organic light emitting diode (OLED) emits light according to a driving current flowing to the driving transistor by the voltage stored to the compensation capacitor. Here, the light emitting steps of a plurality of pixels are concurrently generated, and a scan step and the light emitting step are temporally overlapped.

39 Claims, 17 Drawing Sheets

(56) References Cited

U.S. PATENT DOCUMENTS 7,944,414 B2 * 5/2011 Shirasaki ..... G09G 3/3225 345/77
7,978,156 B2 * 7/2011 Kim ..... G09G 3/3233 315/169.3
7,995,009 B2 * 8/2011 Umezaki ..... G09G 3/325 345/76
8,054,250 B2 * 11/2011 Kim ..... G09G 3/3233 315/169.3
8,159,421 B2 * 4/2012 Hwang ..... G09G 3/3233 345/76
8,339,339 B2 * 12/2012 Yamazaki ..... G09G 3/3258 315/169.3
8,354,984 B2 * 1/2013 Choi ..... G09G 3/3233 345/77
8,400,380 B2 * 3/2013 Lee ..... G09G 3/3233 345/77
8,462,089 B2 * 6/2013 Han ..... G09G 3/3233 345/82
8,531,358 B2 * 9/2013 Choi ..... G09G 3/3233 345/76
8,593,378 B2 * 11/2013 Ryu ..... G09G 3/3233 315/169.3
8,614,657 B2 * 12/2013 Han ..... G09G 3/3233 345/77
8,659,511 B2 * 2/2014 Ryu ..... G09G 3/3233 345/76
8,780,102 B2 * 7/2014 Han ..... G09G 3/3233 345/208
8,902,208 B2 * 12/2014 Chung ..... G09G 3/3233 345/211
9,064,458 B2 * 6/2015 Lee ..... G09G 3/003
9,183,778 B2 * 11/2015 Lee ..... G09G 3/003
2002/0018029 A1 * 2/2002 Koyama ..... G09G 3/3275 345/39
2002/0130828 A1 * 9/2002 Yamazaki ..... G09G 3/3258 345/80
2004/0017162 A1 * 1/2004 Sato ..... H01L 27/3276 315/169.3
2004/0113873 A1 * 6/2004 Shirasaki ..... G09G 3/325 345/76
2005/0068271 A1 * 3/2005 Lo ..... G09G 3/3233 345/76
2005/0140605 A1 * 6/2005 Jung ..... 345/76
2005/0200575 A1 * 9/2005 Kim ..... G09G 3/3233 345/76
2005/0206591 A1 * 9/2005 Wang ..... G09G 3/3233 345/76
2005/0258466 A1 * 11/2005 Kwak ..... G09G 3/3233 257/306
2005/0264500 A1 * 12/2005 Shirasaki ..... G09G 3/3225 345/77
2005/0285825 A1 * 12/2005 Eom ..... G09G 3/3233 345/76
2006/0022305 A1 * 2/2006 Yamashita ..... 257/565
2006/0022605 A1 * 2/2006 Ha ..... G09G 3/3233 315/169.3
2006/0028408 A1 * 2/2006 Kim ..... G09G 3/3233 345/76
2006/0043366 A1 * 3/2006 Ha ..... G09G 3/3233 257/59
2006/0044230 A1 * 3/2006 Eom ..... G09G 3/3233 345/76
2006/0066531 A1 * 3/2006 Park ..... G09G 3/20 345/76
2006/0077194 A1 * 4/2006 Jeong ..... G09G 3/3233 345/204
2006/0232678 A1 * 10/2006 Choi ..... G09G 3/3233 348/207.11
2007/0018916 A1 * 1/2007 Kim ..... G09G 3/3216 345/76
2007/0024541 A1 * 2/2007 Ryu ..... G09G 3/3233 345/76
2007/0024542 A1 * 2/2007 Chung ..... G09G 3/2011 345/76
2007/0024543 A1 * 2/2007 Chung ..... G09G 3/3233 345/76
2007/0024544 A1 * 2/2007 Chung ..... G09G 3/3233 345/76
2007/0035487 A1 * 2/2007 Ryu ..... G09G 3/3233 345/76
2007/0040772 A1 * 2/2007 Kim ..... G09G 3/3233 345/76
2007/0040786 A1 * 2/2007 Chung ..... 345/92
2007/0064469 A1 * 3/2007 Umezaki ..... G09G 3/325 365/154
2007/0080905 A1 * 4/2007 Takahara ..... G09G 3/3233 345/76
2007/0085781 A1 * 4/2007 Chung ..... G09G 3/3233 345/76
2007/0262931 A1 * 11/2007 Peng ..... G09G 3/3233 345/76
2007/0279345 A1 * 12/2007 Kim ..... G09G 3/3233 345/80
2008/0036710 A1 * 2/2008 Kim ..... G09G 3/3233 345/82
2008/0088547 A1 * 4/2008 Chan ..... G09G 3/3233 345/76
2009/0002405 A1 * 1/2009 Ozaki ..... G09G 3/325 345/690
2009/0033685 A1 * 2/2009 Park ..... G09G 3/3233 345/690
2009/0051628 A1 * 2/2009 Kwon ..... G09G 3/3233 345/77
2009/0207105 A1 * 8/2009 Hwang ..... G09G 3/3233 345/76
2009/0219232 A1 * 9/2009 Choi ..... 345/76
2009/0225011 A1 * 9/2009 Choi ..... G09G 3/3233 345/77
2009/0309816 A1 * 12/2009 Choi ..... G09G 3/3233 345/76
2010/0141644 A1 * 6/2010 Lee ..... G09G 3/3233 345/214
2010/0141646 A1 * 6/2010 Tanabe ..... G09G 3/2022 345/214
2010/0201656 A1 * 8/2010 Han ..... G09G 3/3233 345/205
2010/0201673 A1 * 8/2010 Kim ..... G09G 3/3225 345/211
2010/0201674 A1 * 8/2010 Kim ..... G09G 3/3233 345/211
2010/0220040 A1 * 9/2010 Kwak ..... G09G 3/3233 345/76
2010/0245402 A1 * 9/2010 Choi ..... G09G 3/3233 345/690
2010/0253608 A1 * 10/2010 Kim ..... G09G 3/3233 345/76
2011/0025586 A1 * 2/2011 Lee ..... G09G 3/003 345/76
2011/0025659 A1 * 2/2011 Kwak ..... G09G 3/3233 345/205
2011/0025671 A1 * 2/2011 Lee ..... 345/211
2011/0050740 A1 * 3/2011 Lee ..... G09G 3/3233 345/690
2011/0057917 A1 * 3/2011 Ryu ..... G09G 3/3233 345/211
2011/0090213 A1 * 4/2011 Han ..... G09G 3/3233 345/213
2011/0095967 A1 * 4/2011 Choi ..... G09G 3/3233 345/76
2011/0109531 A1 * 5/2011 Choi ..... G09G 3/3233 345/76
2011/0115761 A1 * 5/2011 Takei ..... G09G 3/325 345/204
2011/0141000 A1 * 6/2011 Han ..... G09G 3/3233 345/82
2011/0187699 A1 * 8/2011 Yamashita ..... G09G 3/3233 345/212
2011/0199357 A1 * 8/2011 Chung ..... G09G 3/3233 345/211
2011/0227956 A1 * 9/2011 Park ..... G09G 3/3233 345/690
2011/0273428 A1 * 11/2011 Han ..... G09G 3/3233 345/212

(56) References Cited

U.S. PATENT DOCUMENTS

2011/0279437 A1* 11/2011 Komiya ..... G09G 3/3233 345/212
2011/0279484 A1* 11/2011 Han et al. ..... 345/690
2011/0292015 A1* 12/2011 Komiya ..... G09G 3/003 345/211
2012/0007848 A1* 1/2012 Han et al. ..... 345/212
2012/0019501 A1* 1/2012 Choi ..... G09G 3/3233 345/211
2012/0026143 A1* 2/2012 Jang ..... G09G 5/00 345/211
2012/0026147 A1* 2/2012 Komiya ..... G09G 3/3233 345/211
2012/0026155 A1* 2/2012 Komiya ..... G09G 3/003 345/213
2012/0026207 A1* 2/2012 Komiya ..... G09G 3/3233 345/690
2012/0038605 A1* 2/2012 Han ..... H05B 33/0896 345/211

FOREIGN PATENT DOCUMENTS

KR 10-2008-0114169 12/2008
KR 10-0926687 11/2009
KR 10-2011-0013693 2/2011

* cited by examiner

PIXEL, DISPLAY DEVICE INCLUDING THE PIXEL, AND DRIVING METHOD OF THE DISPLAY DEVICE

CROSS-REFERENCE TO RELATED APPLICATION

This application claims priority to and the benefit of Korean Patent Application No. 10-2011-0052357, filed in the Korean Intellectual Property Office on May 31, 2011, the entire content of which is incorporated herein by reference.

BACKGROUND

1. Field

The following description relates to a pixel, a display device including the same, and a driving method thereof. Particularly, the following description relates to a pixel including an organic light emitting diode (OLED), a display device of an active matrix type including the same, and a driving method thereof.

2. Description of Related Art

One frame of the active matrix type of display device includes a scan period for programming image data and a light emitting period for emitting light according to the programmed image data. However, as the size of the display panel is increased and the resolution thereof is increased, the Resistive-Capacitive (RC) delay of the display panel is increased. Thus, the time for programming the image data to each pixel of the display panel is increased such that it is difficult to drive the display device.

Also, when the display device displays a stereoscopic image, this problem may be more sever.

When the display device displays the stereoscopic image according to the National Television System Committee (NTSC) method, the display device must alternately display left eye images of 60 frames and right eye images of 60 frames during one second. Accordingly, the driving frequency of the display device to display the stereoscopic images must be more than at least double compared with the display device displaying a plane image.

When displaying the stereoscopic image, data writing must be completed within at least 1/120 of a second such that a driver operated with a high driving frequency to scan the entire display panel during the scan period and to program the image data is required. The driver of the high driving frequency increases production cost.

The above information disclosed in this Background section is only for enhancement of understanding of the background of the invention and therefore it may contain information that does not form the prior art that is already known in this country to a person of ordinary skill in the art.

SUMMARY

Aspects of embodiments of the present invention are directed toward a pixel suitable for a large-sized and high resolution display device that can display a stereoscopic image, a display device including the same, and a driving method thereof.

A display device according to an embodiment of the present invention includes a plurality of pixels each including an organic light emitting diode (OLED), a driving transistor connected to a driving voltage and supplying a driving current to the organic light emitting diode (OLED), a compensation capacitor connected to the gate electrode of the driving transistor, and a storage capacitor electrically connected to or disconnected from the compensation capacitor.

A driving method of the display device according to an embodiment of the present invention includes: a reset step in which a first voltage corresponding to a data voltage applied to the storage capacitor is transmitted to the compensation capacitor after an anode voltage of the organic light emitting diode (OLED) is discharged and reset; a compensation step in which a voltage corresponding to a threshold voltage of the driving transistor is transmitted to the compensation capacitor; a scan step in which a data voltage is stored according to the data signal corresponding to the storage capacitor; and a light emitting step in which the organic light emitting diode (OLED) emits light according to the driving current flowing to the driving transistor by the voltage stored to the storage capacitor, wherein the light emitting steps of the plurality of pixels are concurrently or simultaneously generated, and the scan step and the light emitting step are temporally overlapped.

The pixel may be embodied as one of first to sixth pixels (or pixels embodiments) as described in more detail below.

For the first pixel, the reset step includes a step in which the data voltage is shifted by a first swing of the driving voltage to generate a first voltage; and a step in which the compensation capacitor and the storage capacitor are connected in series such that the first voltage is divided by the compensation capacitor and the storage capacitor.

The compensation step includes changing the voltage distributed to the compensation capacitor and the storage capacitor by second swing of the driving voltage, and diode-connecting the driving transistor such that the voltage distributed to the compensation capacitor and the storage capacitor is changed.

The reset step further includes an initialization step in which an assistance voltage at the first level is applied to a node at which the compensation capacitor and the storage capacitor are connected.

The light emitting step includes a step in which the voltage stored to the compensation capacitor is changed by an assistance voltage at a second level.

For the second pixel, the reset step further includes a step in which the driving voltage is connected to one terminal of the compensation capacitor, and the anode of the organic light emitting element is connected to the other terminal of the compensation capacitor. The light emitting step includes a step in which the voltage stored to the compensation capacitor is changed by the voltage level of the driving voltage after the second swing of the driving voltage.

For the third pixel, the reset step includes a step in which an assistance voltage is connected to one terminal of the compensation capacitor, a step in which the data voltage is shifted by a first swing of the assistance voltage connected to the storage capacitor such that a first voltage is generated, and a step in which the anode of the organic light emitting diode (OLED) and the other terminal of the compensation capacitor are connected after the first swing of the assistance voltage. The reset step further includes a step in which the compensation capacitor and the storage capacitor are connected in series such that the first voltage is distributed to the compensation capacitor and the storage capacitor. The light emitting step includes a step in which the voltage stored to the compensation capacitor is changed by the voltage level of the assistance voltage after a second swing of the assistance voltage.

For the fourth pixel, the reset step includes a step in which the driving voltage is connected to one terminal of the compensation capacitor, and the anode of the organic light emitting element is connected to the other terminal of the compensation capacitor. The reset step further includes a step in which the compensation capacitor and the storage capacitor are connected in series such that the first voltage is distributed to the compensation capacitor and the storage capacitor, and the first voltage is the same as the data voltage.

The compensation step includes a step in which the driving transistor is diode-connected such that the voltage distributed to the compensation capacitor and the storage capacitor is changed.

The light emitting step includes a step in which the driving voltage is connected to the compensation capacitor such that the voltage stored to the compensation capacitor is changed.

For the fifth pixel, the reset step includes a step in which one terminal of the compensation capacitor is applied with the control voltage and the other terminal of the compensation capacitor is connected to the anode of the organic light emitting diode (OLED), a step in which the data voltage is shifted by the first swing of the driving voltage such that the first voltage is generated and the control voltage is disconnected to one terminal of the compensation capacitor, and a step in which the compensation capacitor and the storage capacitor are connected in series such that the first voltage is distributed to the compensation capacitor and the storage capacitor.

For the sixth pixel, the reset step includes a step in which the control voltage is applied to one terminal of the compensation capacitor, and the other terminal of the compensation capacitor and the anode of the organic light emitting diode (OLED) are connected, and a step in which the control voltage is blocked from one terminal of the compensation capacitor, and the compensation capacitor and the storage capacitor are connected in series such that the first voltage is distributed to the compensation capacitor and the storage capacitor, wherein the first voltage is the same as the data voltage.

The display device further includes a different driving voltage connected to the cathode of the organic light emitting diode, and the voltage level of the different driving voltage during the reset step and the compensation step is different than that during the light emitting step.

A driving method of the display device (including a plurality of pixels, each including a driving transistor, a compensation capacitor, and a storage capacitor) according to an embodiment of the present invention, the method includes: programming first frame data to the storage capacitor of each of the plurality of pixels during a first scan period; programming second frame data to the storage capacitor of each of the plurality of pixels during a second scan period; and transmitting a voltage corresponding to the first frame data voltage programmed to the storage capacitor to the compensation capacitor and emitting light through a plurality of pixels by a driving current flowing in the driving transistor according to the voltage transmitted to the compensation capacitor during a first light emitting period, wherein the second scan period and the first light emitting period are temporally overlapped.

In one embodiment, the first frame data is first view point data, and the second frame data is second view point data different from the first view point data.

A pixel according to an embodiment of the present invention includes: an organic light emitting diode (OLED); a driving transistor electrically connected to the first driving voltage and supplying a driving current to the organic light emitting diode (OLED); a compensation capacitor connected to a gate electrode of the driving transistor; a first operation control transistor including one electrode connected to the other electrode of the compensation capacitor and controlled by the first operation control signal; a second operation control transistor including one electrode connected to the other electrode of the compensation capacitor and controlled by the second operation control signal; and a storage capacitor including one electrode connected to the other electrode of the second operation control transistor, wherein the first operation control transistor is turned on such that the driving current is determined according to the voltage of the compensation capacitor during a period in which the second operation control transistor is turned off and the data voltage according to the data signal corresponding to the storage capacitor is applied.

In one embodiment, the pixel further includes a switching transistor including one electrode connected to one electrode of the storage capacitor, and the other electrode input with a corresponding data signal and controlled by the scan signal. The pixel further includes a compensation transistor connected between the gate electrode and the drain electrode of the driving transistor.

In one embodiment, the first driving voltage is the low level during a period in which the first operation control transistor and the compensation transistor are turned on during the reset period.

In one embodiment, the first driving voltage is the high level during a period in which the second operation control transistor and the compensation transistor are turned-on during the compensation period.

In one embodiment, the pixel further includes an assistance voltage connected to the other electrode of the first operation control transistor, wherein the assistance voltage is the first level during the first period that the first operation control transistor and the compensation transistor are simultaneously turned on, and is swung to the second level different from the first level after the second operation control transistor is turned on after the first period.

In one embodiment, the first driving voltage is the low level during the first period, the first driving voltage is the high level after the second operation control transistor is turned on, the pixel further includes a second driving voltage connected to the cathode of the organic light emitting diode (OLED), and the second driving voltage becomes the low level after the second operation control transistor is turned off.

For the second pixel embodiment, the other electrode of the first operation control transistor is connected to the first driving voltage, the first driving voltage is the low level during the first period in which the first operation control transistor and the compensation transistor are simultaneously turned on, and after the first period, the first driving voltage is the high level after the second operation control transistor is turned on, the pixel further includes a second driving voltage connected to the cathode of the organic light emitting diode (OLED), and the second driving voltage becomes the low level after the second operation control transistor is turned off.

For the third pixel embodiment, the pixel further includes an assistance voltage connected to both the other electrode of the first operation control transistor and the other electrode of the storage capacitor, the assistance voltage is the first level during the first period in which the first operation control transistor and the compensation transistor are simultaneously turned on, and after the first period, the assistance voltage is a second level different from the first level after the second operation control transistor is turned on.

The third pixel embodiment further includes a second driving voltage connected to the cathode of the organic light emitting diode (OLED), wherein after the first period, the first driving voltage becomes the high level after the second operation control transistor is turned on, and the second driving voltage is the low level after the second operation control transistor is turned off and the first operation control transistor is again turned on.

The fourth pixel embodiment further includes a reference voltage connected to the other electrode of the storage capacitor and a second driving voltage connected to the cathode of the organic light emitting diode (OLED), the other electrode of the first operation control transistor is connected to the first driving voltage, the first driving voltage is the low level during the first period in which the first operation control transistor and the compensation transistor are simultaneously turned on, and after the first period, the first driving voltage is the high level after the second operation control transistor is turned on, and the second driving voltage becomes the low level after the second operation control transistor is turned off.

The fifth pixel embodiment further includes a third operation control transistor including one electrode connected to one electrode of the first operation control transistor and operated by the third operation control signal, and a control voltage connected to the other electrode of the third operation control transistor, wherein one electrode of the first operation control transistor is connected to the first driving voltage, the control voltage and the first driving voltage are the low level during the first period in which the third operation control transistor and the compensation transistor are simultaneously turned on, and after the first period, the first control voltage and the first driving voltage are the high level after the second operation control transistor is turned on.

The fifth pixel embodiment further includes a second driving voltage connected to the cathode of the organic light emitting diode (OLED), and the second driving voltage becomes the low level after the second operation control transistor is turned off.

The fifth pixel embodiment further includes a third operation control transistor including one electrode connected to one electrode of the first operation control transistor and operated by the third operation control signal, a control voltage connected to the other electrode of the third operation control transistor, and a second driving voltage connected to the cathode of the organic light emitting diode (OLED), wherein the other electrode of the storage capacitor is connected to the control voltage, the other electrode of the first operation control transistor is connected to the first driving voltage, the control voltage and the first driving voltage are the low level during the first period in which the third operation control transistor and the compensation transistor are simultaneously turned on, and after the first period, the control voltage and the first driving voltage are the high level after the second operation control transistor is turned on and the second driving voltage becomes the low level after the second operation control transistor is turned off.

In one embodiment, the reset step includes a step in which the anode voltage is connected to the driving voltage by the turn-on of the driving transistor and the anode voltage is decreased by the low level of the driving voltage.

A display device according to an embodiment of the present invention includes: a plurality of data lines transmitting a plurality of data signals; a plurality of scan lines transmitting a plurality of scan signals; a first operation control line and a second operation control line transmitting a first operation control signal and a second operation control signal; a first voltage line transmitting a first driving voltage and a second voltage line transmitting a second driving voltage; and a plurality of pixels connected to the corresponding data line, the corresponding scan line, the first operation control line, the second operation control line, the first voltage line, and the second voltage line.

In one embodiment, the pixel includes: an organic light emitting diode (OLED) including a cathode connected to the corresponding second voltage line; a driving transistor connected to the first voltage line and supplying a driving current to the organic light emitting diode (OLED); a compensation capacitor connected to the gate electrode of the driving transistor; a first operation control transistor including one electrode connected to the other electrode of the compensation capacitor and controlled by the first operation control signal transmitted to the corresponding first operation control line; a second operation control transistor including one electrode connected to the other electrode of the compensation capacitor and controlled by the second operation control signal transmitted through the corresponding second operation control line; and a storage capacitor including one electrode connected to the other electrode of the second operation control transistor, wherein a scan period in which the storage capacitor is connected to the corresponding data line according to the scan signal transmitted through the corresponding scan line, and a light emitting period in which the first operation control transistor is turned on and the second operation control transistor is turned off such that the driving transistor supplies the driving current according to a voltage stored to the compensation capacitor, are temporally overlapped.

In one embodiment, the display device further includes a plurality of compensation control lines transmitting a compensation signal, and the pixel further includes a compensation transistor connected to the gate electrode and the drain electrode of the driving transistor and operated according to the compensation signal.

In one embodiment, the second driving voltage is the low level only during the light emitting period.

Here, embodiments of the present invention provide a pixel suitable for a large size and high resolution display device that can display a stereoscopic image, a display device including the same, and a driving method thereof.

DETAILED DESCRIPTION

Figure 1:
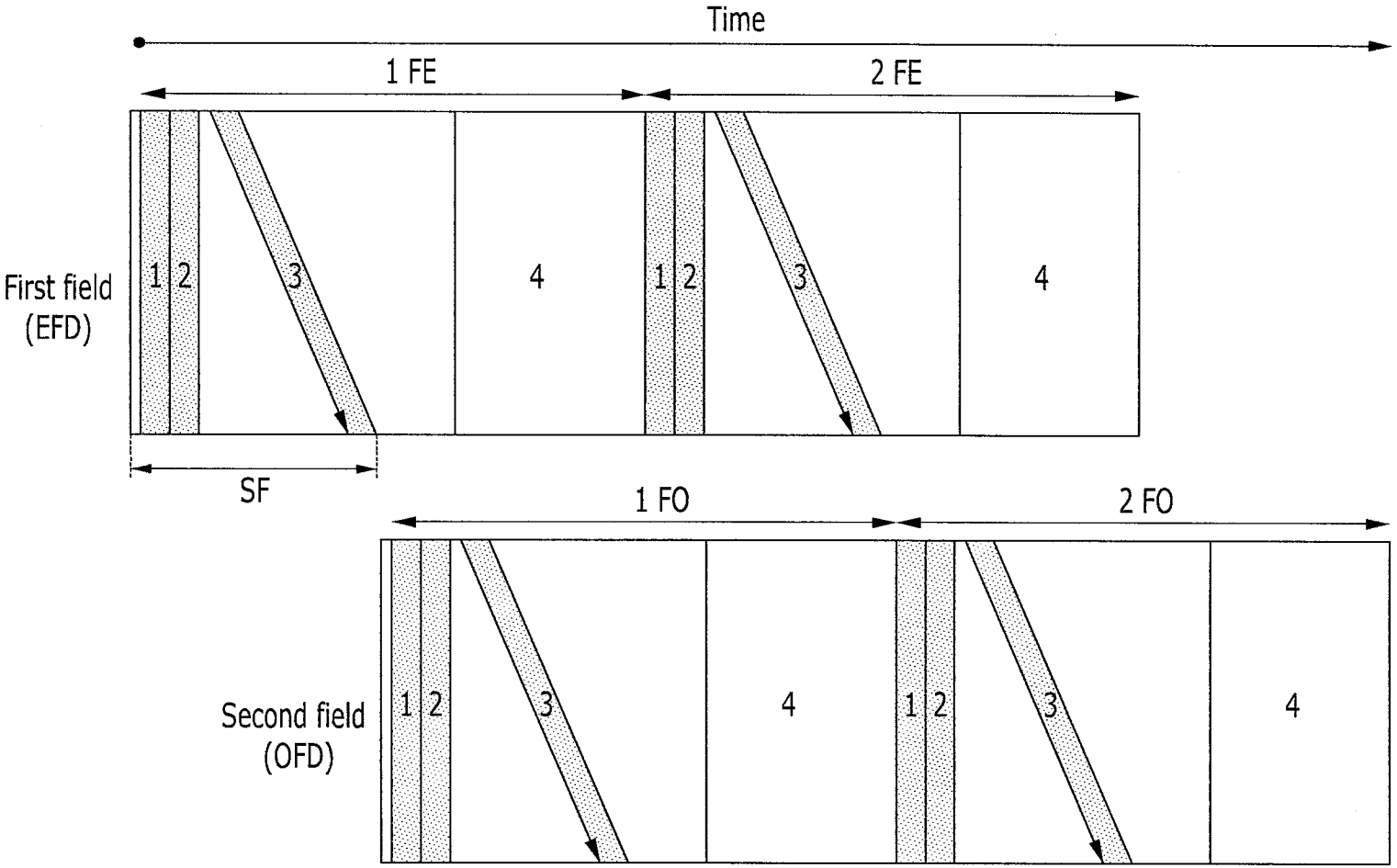
FIG. 1 is a view showing a case of driving all pixels of a display unit divided into two groups.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "indirectly or electrically coupled" to the other element through one or more third elements. In addition, unless explicitly described to the contrary, the word "comprise" and variations such as "comprises" or "comprising" will be understood to imply the inclusion of stated elements but not the exclusion of any other elements.

A display device according to an exemplary embodiment of the present invention is operated by a concurrent or simultaneous light emitting method. The concurrent or simultaneous light emitting method refers to a method in which a plurality of pixels that are light-emitted during a corresponding frame concurrently or simultaneously emit light such that an image of one frame displayed by the display device is displayed.

For concurrent or simultaneous light emitting by all pixels during the light emitting period, data writing must be completed for all pixels before the light emitting period. If the period of one frame is divided into a scan period for programming the data to all pixels and the light emitting period, the scan period may be less than half of one frame period. Also, the light emitting period may be less than half of one frame period.

To sufficiently obtain the light emitting period and the scan period, all pixels of the display device are divided into two groups, and the two groups may be alternatively operated with the scan period or the light emitting period.

FIG. 1 is a view showing a case of driving all pixels of a display unit divided into two groups.

A plurality of pixels of the display unit are divided into a plurality of first group pixels emitting light during the first field and a plurality of second group pixels emitting light during the second field. The first field and the second field are display periods including at least one frame, and one frame may sequentially include a reset period 1, a compensation period 2, a scan period 3, and a light emitting period 4.

The reset period 1 is a period for resetting an anode voltage of an organic light emitting diode OLED by a discharge, and compensating a threshold voltage of the driving transistor of the pixel of the compensation period 2.

Also, the first field EFD and the second field OFD are driven in synchronization with a time that is moved by a set or predetermined period SF. In detail, one frame 1FO of the second field that is temporally close to one frame 1FE of the first field EFD, is temporally shifted by a period SF from the one frame 1FE. The period SF is set up to not overlap the scan period 3. One frame 2FE of the first field is continuous to the frame 1FE, and one frame 2FO of the second field is continuous to the frame 1FO.

A scan period 3 in which the data signal respectively corresponding to the second group pixels is programmed is generated during the period 4 in which the first group pixels emit light. Likewise, the scan period 3 in which the data signal respectively corresponding to the second group pixels is programmed is generated during a period 4 in which the second group pixels emit light. Accordingly, the scan period 3 may be sufficiently obtained such that a temporal margin to drive the display panel is increased. Also, the scan frequency may be decreased such that the bandwidth of a data driver generating the data signal and transmitting the data signal to a data line, and the bandwidth of a gate driver generating the scan signal, are decreased, and thereby cost of a circuit element may be reduced.

As described above, when the pixels are divided into two groups and the field in which each group emits light is divided and operated, the display device may be manufactured with a large size and high resolution. Also, the display device is driven according to the concurrent or simultaneous light emitting such that a motion blur may be reduced compared with the conventional sequential emitting of the light according to the scan lines. In addition, when two groups respectively display the image of a set or predetermined view point, the display device displays a screen of different view points for two groups such that a stereoscopic image display is possible.

However, to divide a plurality of pixels into two groups, a driving voltage must be divided and supplied to the two groups, and a wire supplying the driving voltage must be separated. Also, a pixel circuit structure and a wire structure may be complicated according to the arrangement of the first group pixels and the second group pixels. That is, the panel design may be complicated.

The data representing the image must also be mapped according to the arrangement of the first group pixels and the second group pixels such that the constitution and operation of a controller mapping the data may be complicated.

In addition, since a time difference of the light emitting exists between the first group pixels and the second group pixels, when a pattern is moved with a set or predetermined speed, the shape of the arrangement in the panel of the first group pixels and the second group pixels may be recognized as a pattern. This is referred to as a motion artifact.

Figure 2:
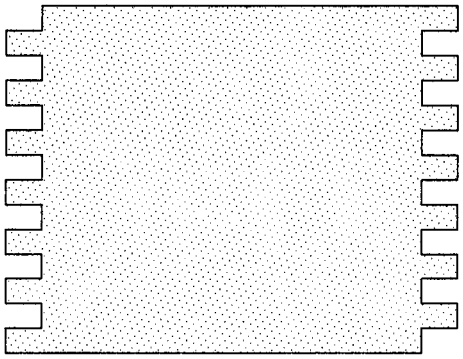
FIG. 2 is a view of a motion artifact that may be generated in a display device.

FIG. 2 is a view of a motion artifact that may be generated in a display device. FIG. 2 shows the motion artifact that may be generated when the first group pixels and the second group pixels are formed per pixel row.

As shown in FIG. 2, the arrangement of the first group pixels and the second group pixels is recognized. Thus, as shown in FIG. 2, the motion artifact in which the block edges of each group appear to be missing according to the arrangement of two groups may be generated.

Embodiments of the present invention provide a display device in which the operation of the light emitting period and the operation of the scan period are executed for a plurality of pixels, as a display device driven by the concurrent or simultaneous light emitting method. Thus, the scan period and the light emitting period may be sufficiently obtained, and the above-described drawbacks such as the motion artifact, being generated in the display device in which the pixels are not divided into two groups, may be reduced or prevented.

In addition, the scan and light emitting are executed together for each pixel such that the display device of an embodiment of the present invention may extend the data writing period and the light emitting period.

Next, an exemplary embodiment of the present invention will be described with reference to FIG. 3.

Figure 3:
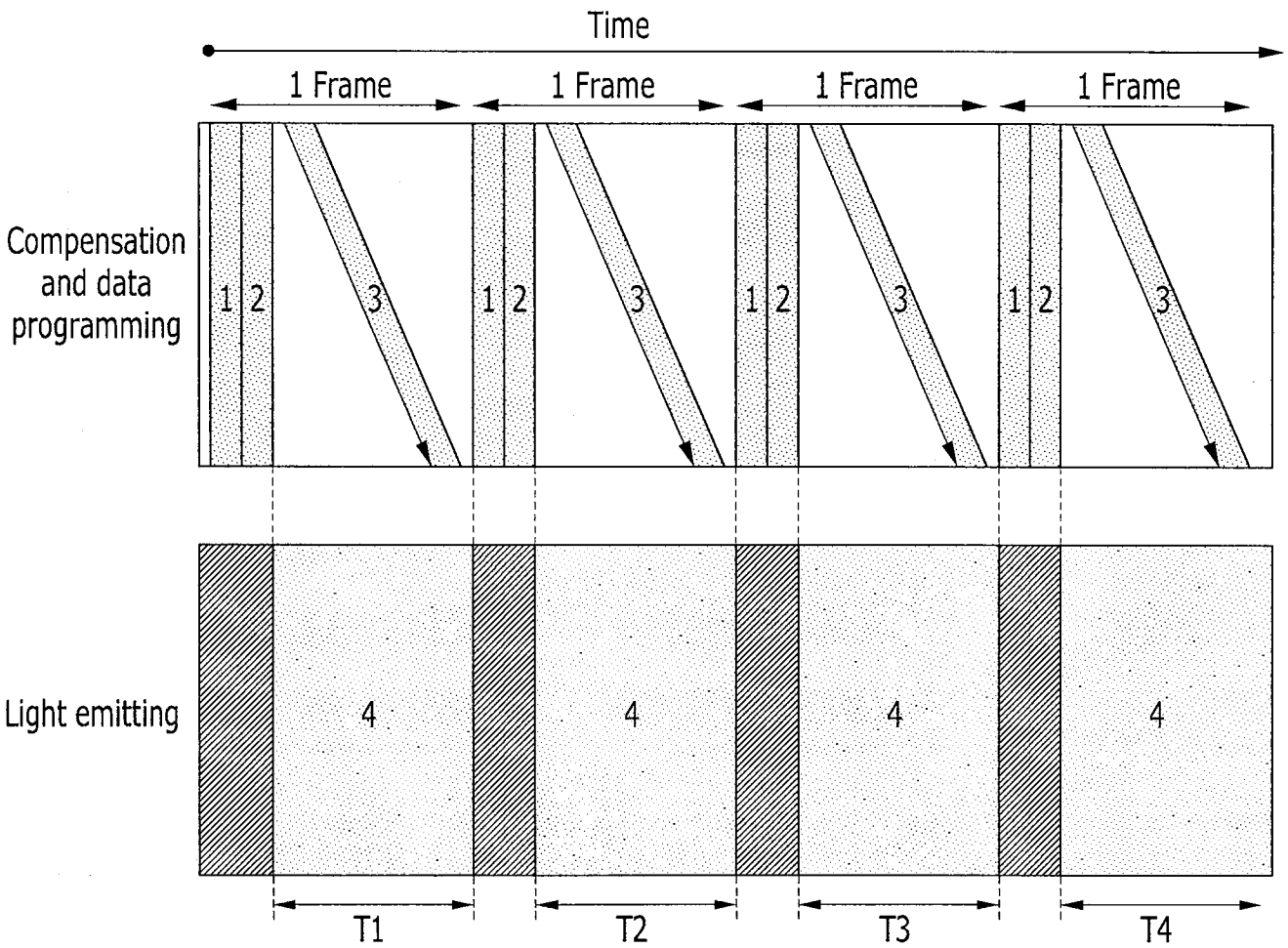
FIG. 3 is a view showing a driving method of a display device according to an exemplary embodiment of the present invention.

FIG. 3 is a driving method of a display device according to an exemplary embodiment of the present invention.

As shown in FIG. 3, one frame includes the reset period 1, the compensation period 2, the scan period 3, and the light emitting period 4. The scan period 3 and the light emitting period 4 are generated to be temporally overlapped.

The pixel emits light according to the data programmed at the scan period 3 of the previous frame, at the light emitting period 4 of the current frame, and the pixel emits light at the light emitting period 4 of the next frame according to the data programmed to the pixel, at the scan period 3 of the current frame.

The period T1 includes the scan period 3 and the light emitting period 4 of the N-th frame. Accordingly, the data programmed to the pixels at the scan period 3 of the period T1 is the data of the N-th frame, and the pixels emit the light according to the data of the N-th frame programmed at the scan period 3 of the (N−1)-th frame at the light emitting period 4 of the period T1.

The period T2 includes the scan period 3 and the light emitting period 4 of the (N+1)-th frame. Accordingly, the data programmed to the pixels at the scan period 3 of the period T2 is the data of the (N+1)-th frame, and the pixels at the light emitting period 4 of the period T2 emit the light according to the data of the N-th frame programmed at the scan period 3 (that is, the period T1) of the N-th frame.

In the scan period 3 of the periods T3 and T4, the data of the (N+2)-th frame and the data of the (N+3)-th frame are programmed to the pixels, and in the light emitting period 4 of the periods T3 and T4, the pixels emit light according to the data programmed at the scan period 3 of the (N+1)-th frame and the data programmed at the scan period 3 of the (N+2)-th frame.

A structure of the pixel in which the data of the current frame is programmed in the scan period 3, and in which the pixel in the light emitting period 4 is at the same period as the scan period 3 emits the light according to the data of the previous frame, will be described with reference to FIG. 4 and FIG. 5.

Figure 4:
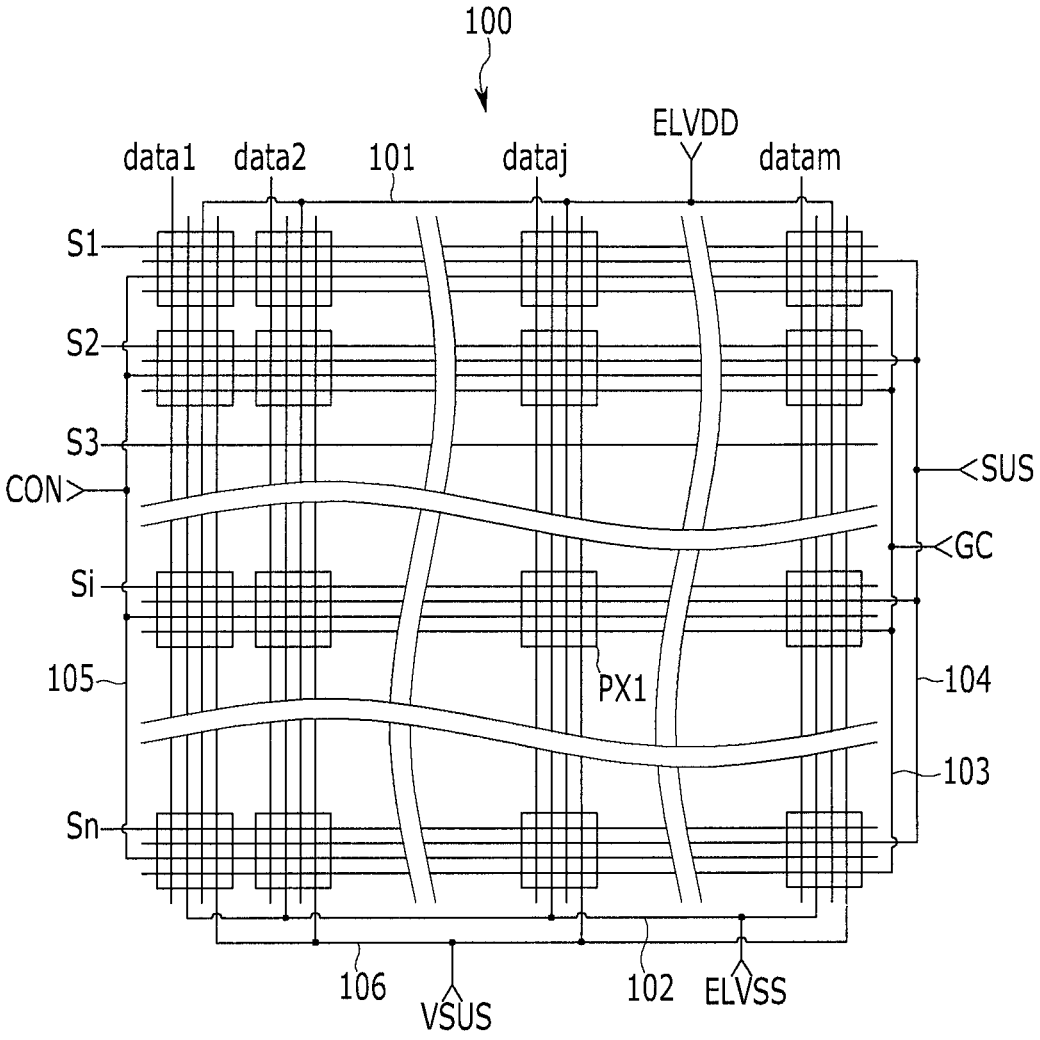
FIG. 4 is a view showing a display unit of a display device according to an exemplary embodiment of the present invention.

FIG. 4 is a view of a display unit 100 of a display device according to an exemplary embodiment of the present invention.

As shown in FIG. 4, the display unit 100 includes a plurality of scan lines S1-Sn, a plurality of data lines data1-datam, a first voltage line 101, a second voltage line 102, a compensation control line 103, a first operation control line 104, a second operation control line 105, and an assistance voltage line 106.

The plurality of scan lines S1-Sn respectively extend in a transverse direction, and the plurality of scan lines S1-Sn are respectively connected to a plurality of pixels PX1 of one row. The plurality of data lines data1-datam extend in a longitudinal direction, and intersect or cross the plurality of first scan lines S1-Sn. The plurality of data lines data1-datam are connected to a plurality of pixels PX1 of one column.

The first voltage line 101 is a wire to respectively transmit a driving voltage ELVDD to a plurality of pixels PX1. The first voltage line 101 may be respectively connected to a plurality of pixels PX1. In FIG. 4, as one example, the first voltage line 101 is formed with a plurality of wires formed in the longitudinal direction and with one connection wire connecting them.

The second voltage line 102 is a wire to respectively transmit a driving voltage ELVSS to a plurality of pixels PX1. The second voltage line 102 may also be connected to a plurality of pixels PX1. In FIG. 4, as one example, the second voltage line 102 includes a plurality of wires formed in the longitudinal direction and one connection wire connecting them.

The compensation control line 103 is a wire to respectively transmit a compensation control signal GC to a plurality of pixels PX1. The compensation control line 103 may also be respectively connected to a plurality of pixels PX1. In FIG. 4, as one example, the compensation control line 103 includes a plurality of wires formed in the transverse direction and one connection wire connecting them.

The first operation control line 104 is a wire to respectively transmit the first operation control signal SUS to a plurality of pixels PX1. The first operation control line 104 may be respectively connected to a plurality of pixels PX1. In FIG. 4, as one example, the first operation control line 104 includes a plurality of wires formed in the transverse direction and one connection wire connecting them.

The second operation control line 105 is a wire to respectively transmit the second operation control signal CON to a plurality of pixels PX1. The second operation control line 105 may be respectively connected to a plurality of pixels PX1. In FIG. 4, as one example, the second operation control line 105 includes a plurality of wires formed in the transverse direction and one connection wire connecting them.

The assistance voltage line 106 is a wire to respectively transmit the assistance voltage SUS to a plurality of pixels PX1. The assistance voltage line 106 may be respectively connected to a plurality of pixels PX1. In FIG. 4, as one example, the assistance voltage line 106 includes a plurality of wires formed in the transverse direction and one connection wire connecting them.

A plurality of pixels PX are respectively connected to the corresponding data line of a plurality of data lines, the corresponding scan line of a plurality of scan lines, two driving voltage lines, the assistance voltage line, the compensation control line, the first operation control line, and the second operation control line.

Next, the structure of a pixel PX1 will be described with reference to FIG. 5.

Figure 5:
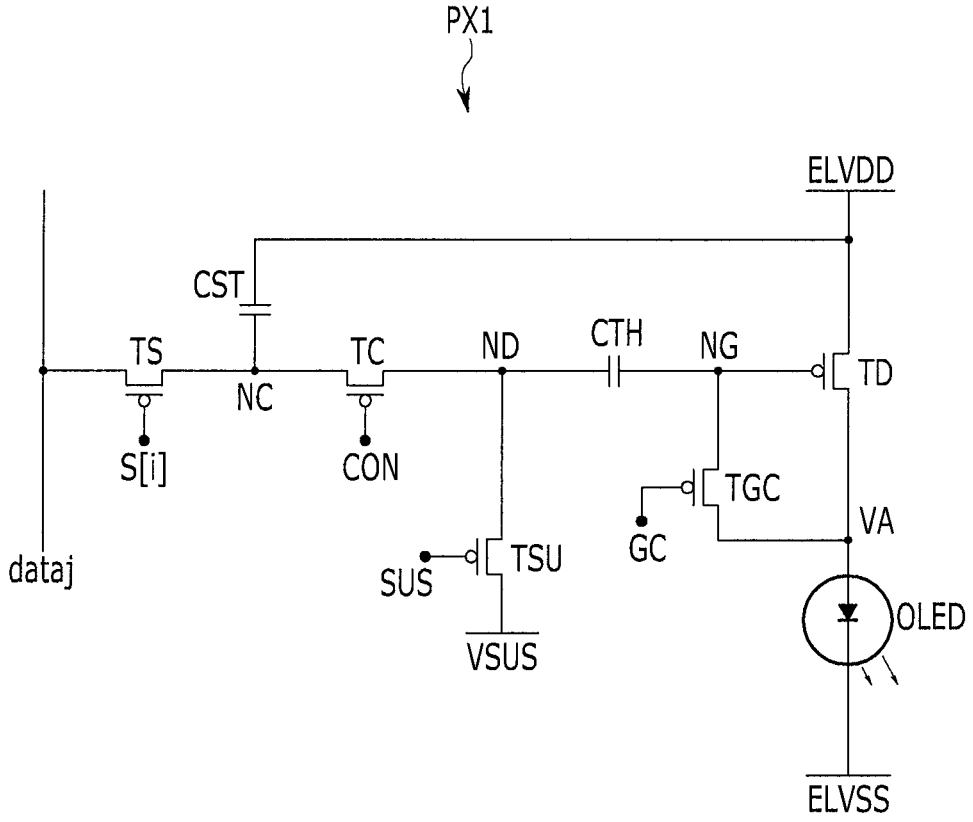
FIG. 5 is a view of a first pixel according to an exemplary embodiment of the present invention.

FIG. 5 is a view of the pixel PX1. The pixel PX1 shown in FIG. 5 is a pixel connected to the scan line Si and the data line dataj. The other pixels are the same as the pixel shown in FIG. 5.

As shown in FIG. 5, the pixel includes five transistors TD, TS, TC, TSU, and TGC, a storage capacitor CST, a compensation capacitor CTH, and an organic light emitting diode OLED.

The driving voltage ELVDD and the driving voltage ELVSS for operating the pixel are supplied to both terminals to which the driving transistor TD and the organic light emitting diode OLED are connected in series.

The five transistors TD, TS, TC, TSU, and TGC shown in FIG. 5 are P-channel transistors. However, the present invention is not limited thereto, and the channel type of each transistor is determined according to the signal level input to the gate electrode of each transistor and the operation state of each transistor according to the signal level.

The driving transistor TD includes the source electrode connected to the driving voltage ELVDD, the drain electrode connected to the anode of the organic light emitting diode OLED, and the gate electrode connected to the compensation capacitor CTH.

The compensation transistor TGC includes electrodes respectively connected to the gate electrode and the drain electrode of the driving transistor TD, and a gate electrode input with the compensation control signal GC. The compensation transistor TGC diode-connects the driving transistor TD in the compensation period 2.

The compensation capacitor CTH includes one electrode connected to the gate electrode of the driving transistor TD and another electrode connected to one electrode of each of two transistors TC and TSU.

The first operation control transistor TSU includes a gate electrode input with the first operation control signal SUS, the one electrode connected to the other electrode of the compensation capacitor CTH, and another electrode connected to the one electrode of the second operation transistor TC.

The second operation control transistor TC includes the gate electrode input with the second operation control signal CON, the one electrode connected to the other electrode of the compensation capacitor CTH, and another electrode connected to both one electrode of the switching transistor TS and one electrode of the storage capacitor CST.

The switching transistor TS includes a gate electrode input with the scan signal S[i], one electrode connected to both the other electrode of the second operation control transistor TC and the one electrode of the storage capacitor CST, and another electrode connected to the data line dataj.

The other electrode of the storage capacitor CST is connected to the voltage ELVDD.

Figure 6:
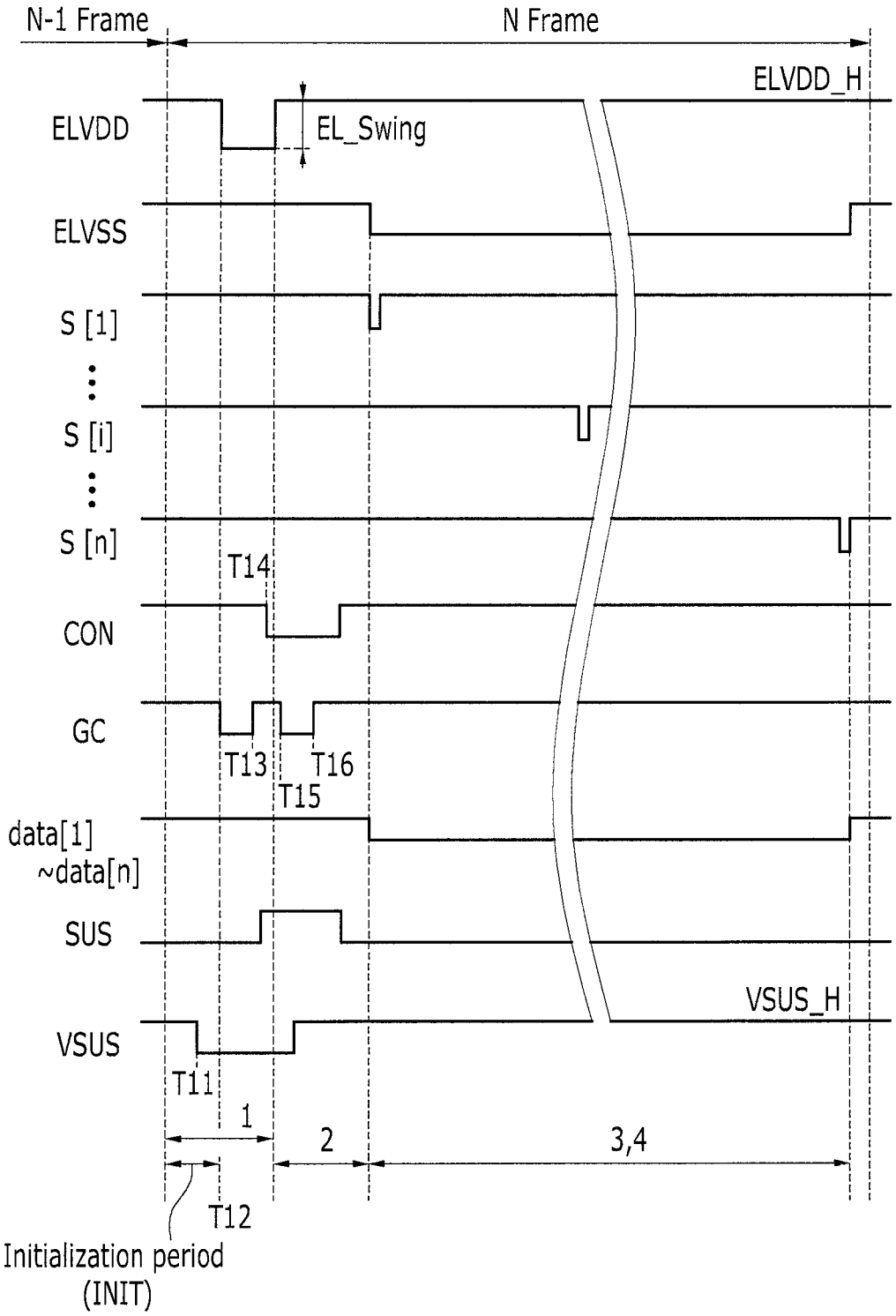
FIG. 6 is a view showing a driving waveform of a display device according to an exemplary embodiment of the present invention.

As shown in FIG. 6, the driving voltages ELVDD and ELVSS, the assistance voltage VSUS, the scan signals S[1]-S[n], the first operation control signal SUS, the second operation control signal CON, the data signals data[1]-data[m], and the compensation control signal GC are respectively changed according to the reset period 1, the compensation period 2, the scan period 3, and the light emitting period 4.

In FIG. 6, the reset period 1 includes an initialization period INIT. However, the present invention is not limited thereto, and the initialization operation may be omitted according to the characteristics of the display panel.

The response waveform of the organic light emitting diode OLED is affected by a hysteresis characteristic of the driving transistor TD supplying the driving current to the organic light emitting diode OLED. For example, in the characteristic curve between the drain current and the gate-source voltage of the driving transistor, a difference between the drain current of the direction that the gate-source voltage is increased and the drain current of the direction that the gate-source voltage is decreased is generated. This phenomenon is the hysteresis characteristic of the driving transistor.

For the same data signal, if the current flowing to the organic light emitting diode OLED when the organic light emitting diode OLED is changed from a high luminance to a low luminance, and the current flowing to the organic light emitting diode OLED when the organic light emitting diode OLED is changed from the low luminance to the high luminance are different, a motion blur is generated. This means that the response waveform of the organic light emitting diode OLED is affected in a case of receiving an influence by the hysteresis characteristic. The initialization period is to eliminate the hysteresis characteristic by initializing the voltage of the gate electrode of the driving transistor.

Among the initialization period INIT, the assistance voltage VSUS becomes the voltage of the low level at the view point T11. Here, the first operation control signal SUS is the low level such that the transistor TSU is in the on state. Accordingly, the voltage of the node ND is changed according to the change of the assistance voltage VSUS. Here, the voltage of the node NG coupled to the node ND through the compensation capacitor CTH is also changed.

The voltage change of the assistance voltage VSUS is to initialize the node NG and the node ND that connect to the gate electrode of the driving transistor TD. Accordingly, the low level of the assistance voltage VSUS is set up as a voltage level for appropriate initialization.

In the initialization period INIT, the gate electrode of the driving transistor TD is initialized by the assistance voltage VSUS such that the driving transistor TD is turned on. Here, the driving voltage ELVSS is the high level such that the current does not flow to the organic light emitting diode OLED, and thereby the light emitting is not generated.

Among the reset period 1, the driving voltage ELVDD is changed from the high level into the low level at the view point T12, and the compensation control signal GC becomes the low level. The anode of the organic light emitting diode OLED and the node NG are connected by the compensation control signal GC, and the voltage VA of the anode of the organic light emitting diode OLED and the voltage of the node NG are reset as the low voltage by the low level of the driving voltage ELVDD.

After the compensation control signal GC becomes the high level at the view point T13 of the reset period 1, the first operation control signal SUS becomes the high level and the second operation control signal CON becomes the low level. Thus, after the compensation transistor TGC is turned off, the first operation control transistor TSU is turned off and the second operation control transistor TC is turned on.

If the second operation control transistor TC is turned on, the voltage stored to the storage capacitor CST is applied to the node ND. The voltage applied to the node ND is a voltage that is shifted by the value that the driving voltage ELVDD is swung from the data voltage VDATA applied to one terminal of the storage capacitor CST according to the data signals data[1]-data[m] corresponding to the scan period of the previous frame (an (N−1)-th frame, not shown) at the view point T12.

Accordingly, the driving voltage ELVDD is decreased by a swing voltage EL_Swing at the view point T12, and then becomes the voltage applied to the node ND.

As described above, in the reset period 1 according to an exemplary embodiment of the present invention, the voltage corresponding to the data voltage of the previous (N−1)-th frame is transmitted to the node ND, that is, the compensation capacitor CTH.

A parasitic capacitor CP of the driving transistor TD is connected to the compensation capacitor CTH in series such that the capacitor of the driving transistor for the node ND is a capacitor (CTH*CP/CTH+CP) (hereafter indicated by CX) of which the compensation capacitor CTH and the parasitic capacitor CP are connected in series.

Accordingly, if the second operation control transistor TC is turned on at the view point T14 of the reset period 1, the capacitor CX and the capacitor CST are connected in series, and the voltage VDT_1 of the node ND by the charge sharing of two capacitors is represented as in Equation 1 below.

$$VDT_1 = a*VC \qquad \text{Equation 1}$$

Here, a is equal to CST/(CST+CX). Each capacitance of the capacitor CST and the capacitor CX is respectively represented by 'CST' and 'CX'. 'VC' refers to the voltage VDATA−EL_Swing of the data voltage VDATA and is determined according to the data signal of the previous (N−1)-th frame that is changed according to the swing of the driving voltage ELVDD.

As described above, the voltage VDATA−EL_Swing is divided to two capacitors by the series connection of the compensation capacitor CTH and the storage capacitor CST.

Next, the compensation period 2 is the period to compensate the threshold voltage VTH of the driving transistor TD. If the driving voltage ELVDD becomes the high level ELVDD_H at the compensation period 2, the voltage of the node ND is changed according to the swing of the driving voltage ELVDD. The voltage charge of the driving voltage ELVDD is shared by the capacitor CST and the capacitor CX such that the voltage VDT_2 of the node ND may be represented by Equation 2.

$$VDT_2=VDT_+a*EL_\text{Swing} \quad \text{Equation 2}$$

As described above, the voltage distributed between the storage capacitor CST and the capacitor CX is changed by the increase of the driving voltage ELVDD. The voltage change of the node ND is the change of the voltage distributed between the storage capacitor CST and the capacitor CX.

Next, if the compensation control signal GC becomes the low level at the time or view point T15 such that the compensation transistor TGC is turned on, the node NG is applied with the voltage ELVDD_H+VTH as the sum of the high level voltage ELVDD_H of the driving voltage ELVDD and the threshold voltage VTH of the driving transistor TD. The threshold voltage VTH of the driving transistor TD is a negative voltage. The voltage VDT_2 of the node ND is influenced by the voltage of the node NG.

In detail, the voltage of the node ND coupled to the node NG through the capacitor CTH is increased, the voltage increasing variation of the node NG is shared to the capacitor CST and the capacitor CTH, and the voltage increasing variation of the node ND may be represented by Equation 3.

$$VDT_R=b*EL_\text{var} \quad \text{Equation 3}$$

Here, b is equal to a ratio of the capacitance of the capacitor CTH for the capacitance sum of the capacitor CST and the capacitor CTH. That is, b is equal to CTH/(CTH+CST), and the capacitance of the capacitor CST and the capacitance of the capacitor CTH are represented by 'CST' and 'CTH', respectively.

The voltage EL_var is the increasing variation of the voltage of the gate electrode of the diode-connected driving transistor TD, that is, the voltage increasing variation of the node NG.

Finally, the voltage VDT_F of the node ND is represented by Equation 4 in which the voltage VDT_R is added to the voltage VDT_2.

$$VDT_F=a*VC+a*EL_\text{Swing}+b*EL_\text{var}=a(V\text{DATA}-EL_\text{Swing})+a*EL_\text{Swing}+b*EL_\text{var}=a*V\text{DATA}+b*EL_\text{var} \quad \text{Equation 4}$$

Accordingly, the capacitor CTH stores the voltage ELVDD_H+VTH−VDT_F.

If the compensation control signal GC becomes the high level at the view point T16, the compensation transistor TGC is turned off. At this time, the second operation control transistor TC is in the turn-on state such that the voltage of the node ND is maintained by the capacitor CST and the voltage of the node NG is also maintained by the capacitor CTH. That is, the voltage ELVDD+VTH−VDT_F stored to the capacitor CTH is maintained by the capacitor CST and the capacitor CTH.

Before the scan and light emitting periods 3 and 4 after the compensation period 2 is finished, the second operation control signal CON becomes the high level such that the second operation control transistor TC is turned off, and the first operation control signal SUS becomes the low level such that the first operation control transistor TSU is turned on.

The driving voltage ELVSS becomes the low level and the assistance voltage VSUS is connected to the node ND at the light emitting period 4 such that the voltage of the gate electrode of the driving transistor TD, that is, the node NG, is reflected by the voltage variation of the node ND as in the following Equation 5.

$$VG=ELVDD_H+VTH+(VSUS_H-VDT_F) \quad \text{Equation 5}$$

At this time, 'VSUS_H−VDT_F' is the voltage variation of the node ND.

The driving voltage ELVSS is the low level during the light emitting period 4 such that the driving current flows to the organic light emitting diode OLED. At this time, the flowing driving current IOLED may be represented by Equation 6.

$$\begin{aligned} IOLED &= k(VGS-VTH)\text{^}2 \quad \text{Equation 6} \\ &= k\{(ELVDD+VTH+\text{VSUS_H}-\text{VDT_F})-ELVDD-VTH\}\text{^}2 \\ &= k(\text{VSUS_H}-\text{VDT_F})\text{^}2 \end{aligned}$$

Here, k is a parameter determined according to a characteristic of the driving transistor TD.

As described above, the driving current IOLED is not affected by the driving voltage ELVDD and the threshold voltage VTH such that it is not affected by the voltage drop IR-DROP generated in the wire transmitting the driving voltage ELVDD and the threshold voltage deviation of the driving transistor TD. Accordingly, uniform screen display is possible.

During the scan period 3, the second operation control transistor TC is in the turn-off state, a plurality of scan signals S[1]-S[n] sequentially become the low level of the enable level, and the switching transistor TS corresponding to a corresponding one of a plurality of scan signals S[1]-S[n] is turned on.

The data signal VDATA of the current N frame is transmitted to the node NC through the turned-on switching transistor TS, is stored to the capacitor CST, and is maintained.

The voltage transmitted to each pixel and stored to the capacitor CST during the N-th frame is transmitted to the driving transistor TD at the light emitting period 4 of the next N+1 frame.

As described above, the operation of the light emitting and the operation of the scan of one frame are temporally overlapped such that the sufficient scan period and light emitting period may be obtained. Thus, the increasing of the scan frequency may be reduced or prevented. For example, when displaying one frame with the driving frequency of 120 Hz, the scan operation with the frequency more than 120 Hz, for example 240 Hz, is not necessary. The reset period and the compensation period are very short periods compared with the scan period and the light emitting period such that the scan frequency may be determined as a frequency close to 120 Hz.

Also, the pixels in which the scan operation and the light emitting operation are executed are not divided among a plurality of pixels of the display unit, and the light emitting and the scan are overlapped and executed in one pixel, thereby the motion artifact generated according to the grouping of the pixels may be removed.

Next, another pixel PX2 according to another exemplary embodiment of the present invention will be described.

Hereafter, the above previously described pixel is referred to as the first pixel PX1, and the following pixel is referred to as the second pixel PX2. This second pixel PX2 is also one example of the pixel circuit appropriate for the driving method in which the scan period and the light emitting period are overlapped.

Figure 7:
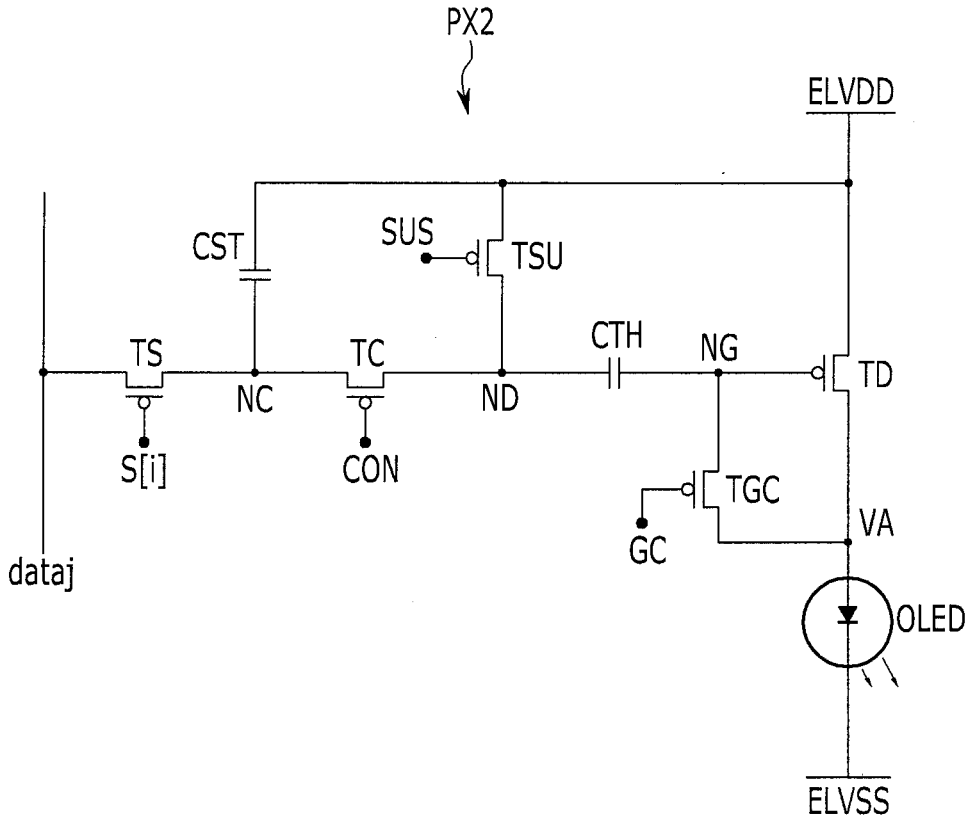
FIG. 7 is a view of a second pixel according to an exemplary embodiment of the present invention.

FIG. 7 is a view of the second pixel PX2 according to an exemplary embodiment of the present invention.

As shown in FIG. 7, in the pixel PX2 compared with the pixel PX1, the assistance voltage VSUS is not used, and the first operation control transistor TSU is connected between the node ND and the driving voltage ELVDD. The remaining structure is the same as that of the first pixel PX1 such that the detailed description is omitted.

Figure 8:
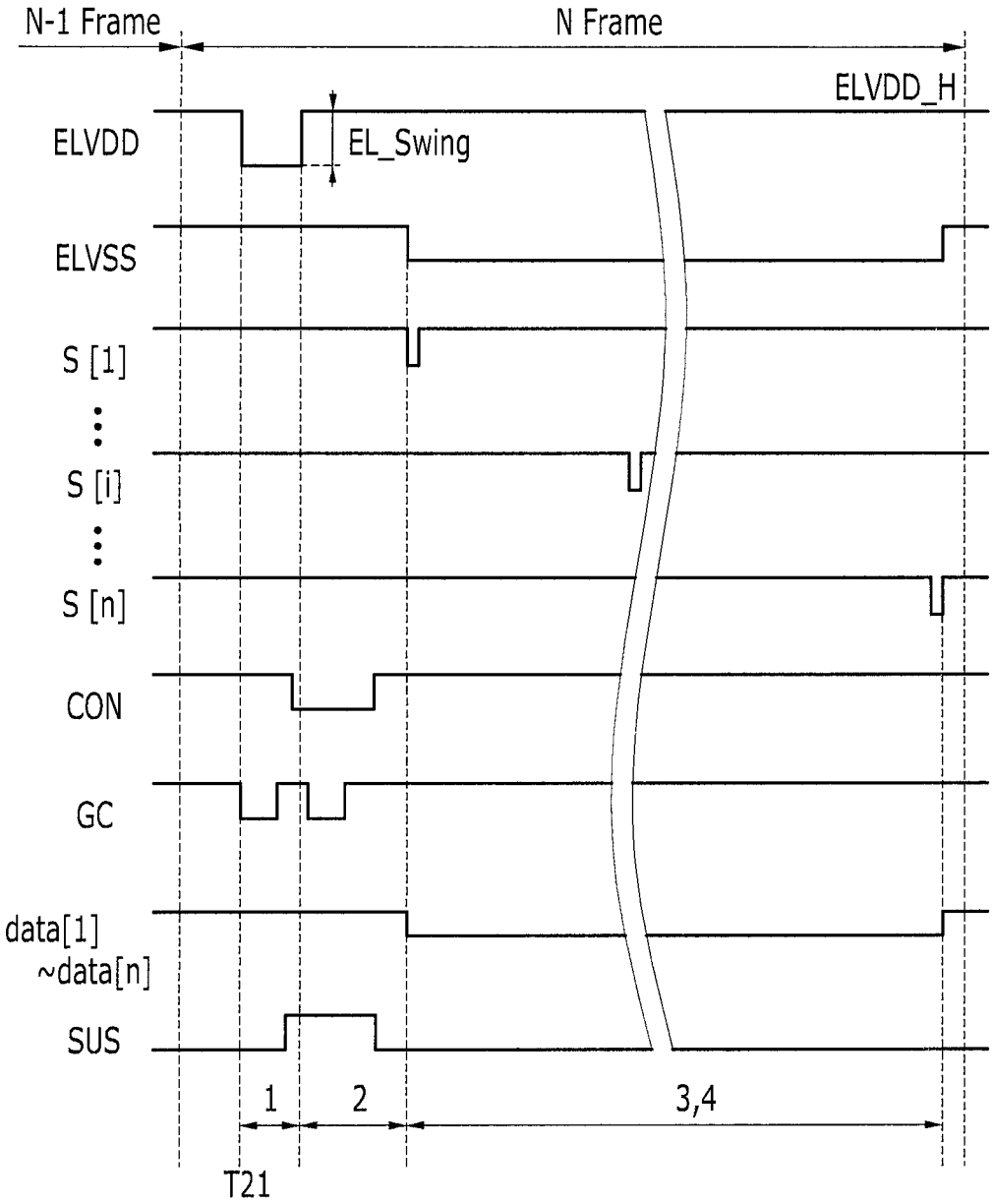
FIG. 8 is a view showing a driving waveform of a display device according to an exemplary embodiment of the present invention applied to the second pixel.

FIG. 8 is a view showing a driving waveform of a display device according to an exemplary embodiment of the present invention applied to the second pixel PX2.

The driving voltage ELVDD is changed from the high level into the low level at the view point T21 of the reset period 1. The first operation control transistor TSU is in the turn-on state, and the driving voltage ELVDD is the low level at the view point T21 such that the voltage of the node ND becomes the low level. The compensation control signal GC is at the low level at the view point T21 such that the compensation control transistor TGC is turned on, and thereby the anode of the organic light emitting diode OLED is connected to the node NG. The node ND and the node NG are coupled to the capacitor CTH, and the voltage of the node ND is decreased to the low level such that the voltage of the node NG is also decreased to the low level.

Thus, the voltage of the node NG is lower than the anode voltage VA enough such that the driving transistor TD is turned on and the current flows from the anode voltage VA to the driving voltage ELVDD of the low level, and thereby the anode voltage VA is decreased.

The node NG and the anode of the organic light emitting diode OLED are connected through the turned on compensation transistor TGC such that the voltage of the node NG is also reset as the low level.

Before the second operation control transistor TC is turned on such that the voltage stored to the storage capacitor CST is transmitted to the node ND, the operation of the first operation control transistor TSU is turned off, which is the same as that of the first pixel PX1.

The operation of the second pixel PX2 at the compensation period 2 and the scan period 3 is the same as that of the first pixel PX1 such that the detailed description is omitted.

The driving voltage ELVSS becomes the low level, and the driving voltage ELVDD is connected to the node ND at the light emitting period 4 such that the gate electrode of the driving transistor TD, that is, the voltage of the node NG, is as in the following Equation 7 and is reflected by the voltage variation of the node ND.

$$VG=ELVDD_H+VTH+(ELVDD_H-VDT_F) \quad \text{Equation 7}$$

Here, 'ELVDD_H−VDT_F' is the voltage variation of the node ND, and 'VDT_F' is the final voltage of the node ND described in Equation 4.

The driving voltage ELVSS is the low level during the light emitting period 4 such that the driving current flows to the organic light emitting diode OLED. At this time, the flowing driving current IOLED may be represented by Equation 8.

$$\begin{aligned} IOLED &= k(VGS-VTH)\text{^}2 \quad \text{Equation 8} \\ &= k\{(\text{ELVDD_H}+VTH+\text{ELVDD_H}-\text{VDT_F})-\text{ELVDD_H}-VTH\}\text{^}2 \\ &= k(\text{ELVDD_H}-\text{VDT_F})\text{^}2 \end{aligned}$$

Here, k is the parameter determined according to the characteristic of the driving transistor TD.

The driving current IOLED of the second pixel PX2 is affected by the voltage drop of the driving voltage ELVDD. The node ND is electrically blocked from the storage capacitor CST and is connected to the driving voltage ELVDD during the light emitting period 4. Also, the node ND and the node NG are coupled through the capacitor CTH. Accordingly, if the voltage drop of the driving voltage ELVDD is generated during the light emitting period 4, it is reflected at the node NG such that the gate-source voltage of the driving transistor TD is not changed. Accordingly, the driving current IOLED of the second pixel PX2 is not affected by the voltage drop of the driving voltage ELVDD under the light emitting.

As described above, the driving current IOLED of the second pixel PX2 is also affected by the voltage drop of the driving voltage ELVDD and the threshold voltage VTH.

In each of FIGS. 5 and 7, the storage capacitor CST is connected to the driving voltage ELVDD, however the present invention is not limited thereto. The storage capacitor CST may be connected to an assistance voltage VSUS.

Figure 9:
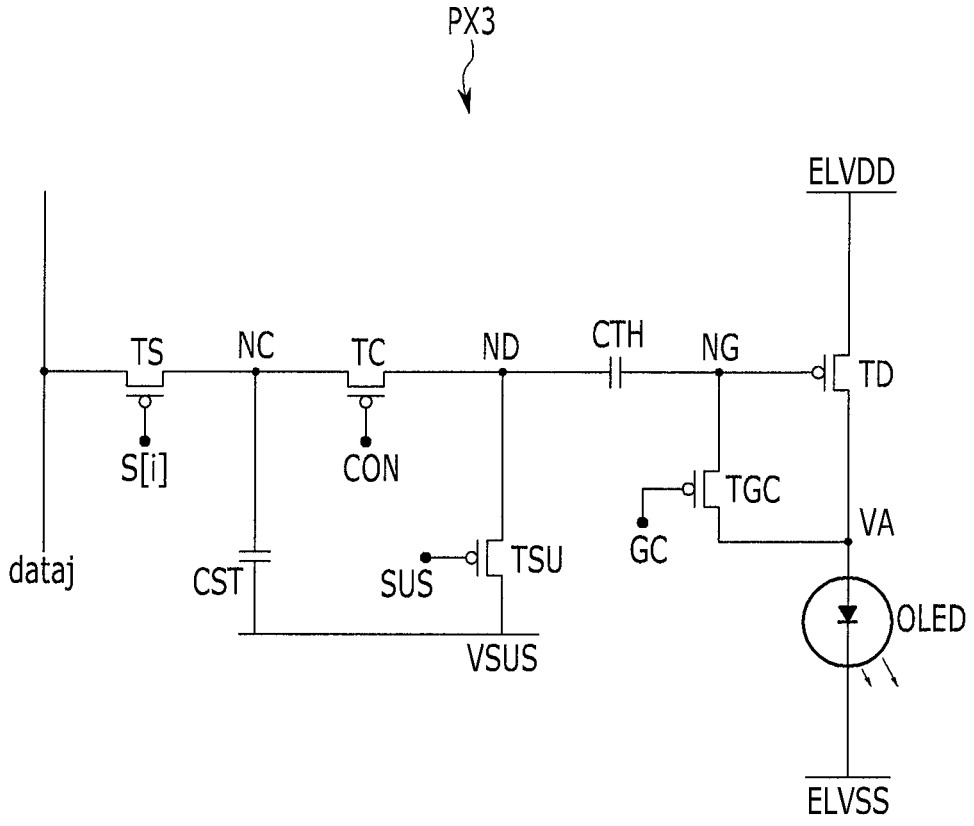
FIG. 9 is a view of a third pixel according to an exemplary embodiment of the present invention.

FIG. 9 is a view of a third pixel PS3 according to an exemplary embodiment of the present invention. The third pixel PS3 is described below in more detail.

In the third pixel PX3 of FIG. 9, the storage capacitor CST is connected between the node NC and the assistance voltage VSUS. Compared with the first pixel PX1, there are no other differences such that the detailed description is omitted.

Figure 10:
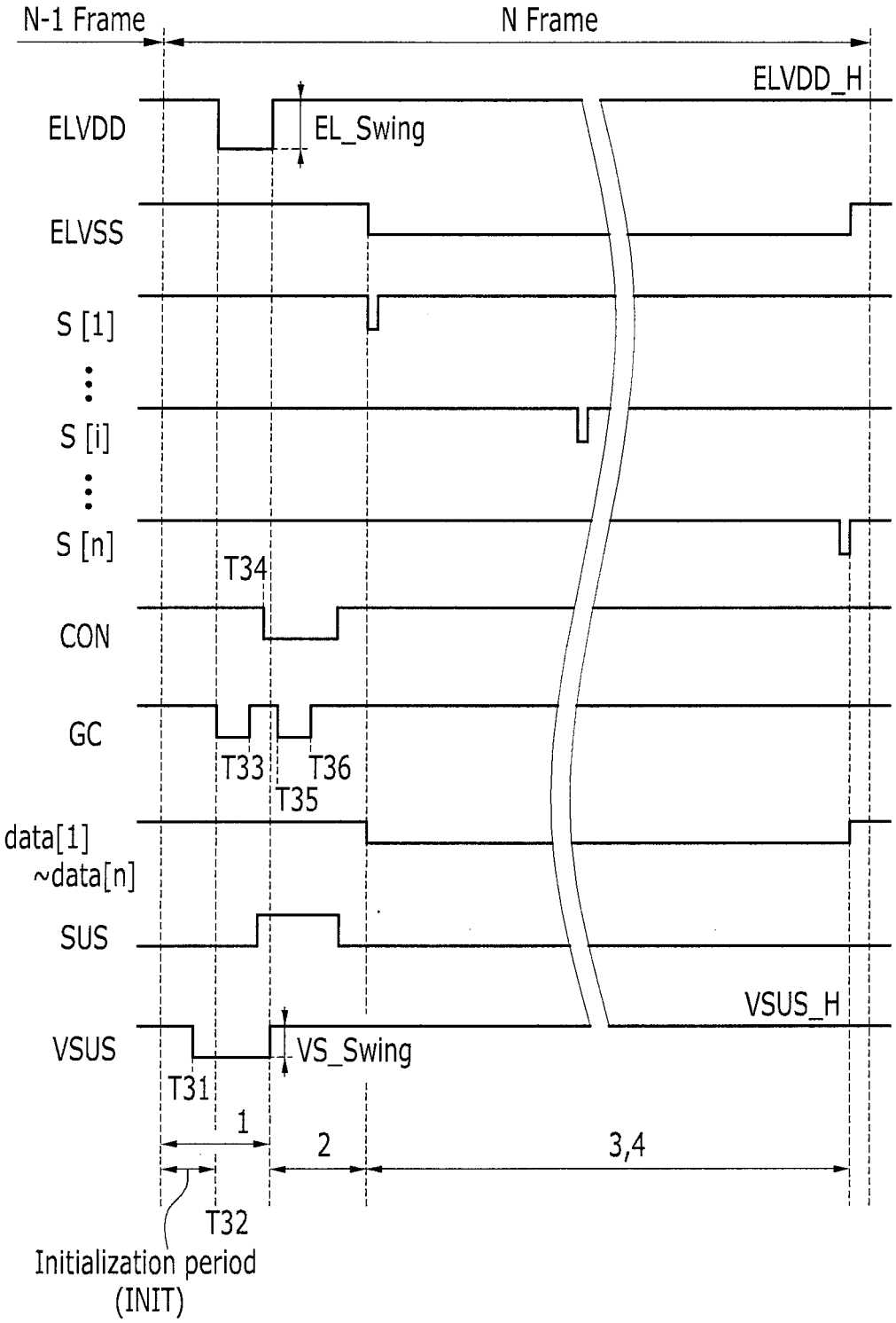
FIG. 10 is a view of a driving waveform of a display device according to an exemplary embodiment of the present invention applied to the third pixel.

FIG. 10 is a view of a driving waveform of a display device according to an exemplary embodiment of the present invention applied to the third pixel PX3.

Referring to FIG. 10, the operation of the third pixel PX3 is described.

Among the reset period 1, the operation of the initialization period INIT is the same as the operation of the first pixel PX1 such that the detailed description is omitted. Also, among the operation of the third pixel PX3 of the reset period 1, the same portion as the operation of the first pixel PX1 described with reference to FIG. 6 is omitted.

At the view point T31, the voltage stored to the storage capacitor CST in the previous (N−1)-th frame is decreased by the swing voltage VS_Swing of the assistance voltage VSUS.

Among the reset period 1, the driving voltage ELVDD is changed from the high level to the low level at the view point T32, and the compensation control signal GC becomes the low level. The anode of the organic light emitting diode OLED and the node NG are connected by the compensation control signal GC, and the driving transistor TD is turned on. Thus, the anode voltage VA of the organic light emitting diode OLED is reset as the low voltage by the driving voltage ELVDD of the low level. The voltage of the node NG is also reset as the low level.

After the compensation control signal GC becomes the high level at the view point T33 among the reset period 1, the first operation control signal SUS becomes the high level and the second operation control signal CON becomes the low level. Thus, after the compensation transistor TGC is turned off, the first operation control transistor TSU is turned off and the second operation control transistor TC is turned on.

If the second operation control transistor TC is turned on, the voltage stored to the storage capacitor CST is applied to the node ND. The voltage applied to the node ND is the voltage of which the voltage stored to the storage capacitor CST according to the corresponding data signals data[1]-data [m] programmed at the scan period of the previous frame (the (N−1)-th frame, not shown), is decreased by the value VS_Swing of which the assistance voltage VSUS is swung at the view point T31.

The assistance voltage VSUS is decreased by the swing voltage VS_Swing at the view point T31 such that the voltage applied to the node ND becomes the voltage VDATA−VS_Swing.

The capacitor CX of the driving transistor for the node ND is 'CTH*CP/(CTH+CP)' such that if the second operation control transistor TC is turned on as the view point T34 of the reset period 1, the capacitor CX and the capacitor CST are connected in series, and the voltage VDT_3 of the node ND by the charge sharing of two capacitors may be represented as Equation 9 below.

$$VDT_3=a*VC1 \qquad \text{Equation 9}$$

At this time, a is equal to CST/(CST+CX), and 'VC1' is the voltage VDATA−VS_Swing.

Next, the compensation period 2 is the period to compensate the threshold voltage VTH of the driving transistor TD. If the assistance voltage VSUS becomes the high level at the compensation period 2, the voltage of the node ND is changed according to the swing of the assistance voltage VSUS. The voltage change VS_Swing of the assistance voltage VSUS is shared by the capacitor CST and the capacitor CX such that the voltage VDT_4 of the node ND is represented as Equation 10 below.

$$VDT_4=VDT_3+a*VS_\text{Swing} \qquad \text{Equation 10}$$

Next, if the compensation control signal GC is the low level at the view point T35 such that the compensation transistor TGC is turned on, the voltage ELVDD_H+VTH as the sum of the high level voltage ELVDD_H of the driving voltage ELVDD and the threshold voltage VTH of the driving transistor TD is applied to the node NG. The voltage VDT_4 of the node ND is affected by the voltage of the node NG. At this time, the increasing amount of the voltage of the node ND is the same as in the above-described Equation 3.

Finally, the voltage VDT_F1 of the node ND is represented as Equation 11 in which the voltage VDT_R is added to the voltage VDT_4.

$$\begin{aligned} \text{VDT_F1} &= a*VC1 + a*\text{VS_Swing} + b*\text{EL_var} \qquad \text{Equation 11} \\ &= a(VDATA - \text{VS_Swing}) + a*\text{VS_Swing} + \\ &\quad b*\text{EL_var} \\ &= a*VDATA + b*\text{EL_var} \end{aligned}$$

Accordingly, the voltage ELVDD_H+VTH−VDT_F1 is stored to the capacitor CTH.

If the compensation control signal GC becomes the high level at the view point T36, the compensation transistor TGC is turned off. At this time, the second operation control transistor TC is in the turned-on state such that the voltage of the node ND is maintained by the capacitor CST and the voltage of the node NG is maintained by the capacitor CTH. That is, the voltage ELVDD+VTH−VDT_F1 stored to the capacitor CTH is maintained by the capacitor CST and the capacitor CTH.

Before the scan and light emitting periods 3 and 4 after the compensation period 2 is finished, the second operation control signal CON becomes the high level such that the second operation control transistor TC is turned off and the first operation control signal SUS becomes the low level, and thereby the first operation control transistor TSU is turned on.

The driving voltage ELVSS becomes the low level at the light emitting period 4, and the assistance voltage VSUS is connected to the node ND such that the gate electrode of the driving transistor TD, that is, the voltage of the node NG, is reflected by the voltage variation of the node ND as in Equation 12.

$$VG=ELVDD_H+VTH+(VSUS_H-VDT_F1) \qquad \text{Equation 12}$$

Here, 'VSUS_H−VDT_F' is the voltage variation of the node ND.

The driving voltage ELVSS is the low level during the light emitting period 4 such that the driving current flows to the organic light emitting diode OLED. At this time, the flowing driving current IOLED is represented as in Equation 13.

$$\begin{aligned} IOLED &= k(VGS - VTH)\text{^}2 \qquad \text{Equation 13} \\ &= k\{(ELVDD + VTH + \text{VSUS_H} - \text{VDT_F1}) - \\ &\quad ELVDD - VTH\}\text{^}2 \\ &= k(\text{VSUS_H} - \text{VDT_F1})\text{^}2 \end{aligned}$$

At this time, k is the parameter determined according to the characteristics of the driving transistor TD.

The operation of the scan period 3 is the same as the above-described operation such that the description is omitted.

As described above, in the third pixel PX3 like the first pixel PX, the driving current IOLED is not affected by the driving voltage ELVDD level and the threshold voltage VTH when writing the data signal.

A fourth pixel PX4 according to an exemplary embodiment of the present invention will be described with reference to FIG. 11.

Figure 11:
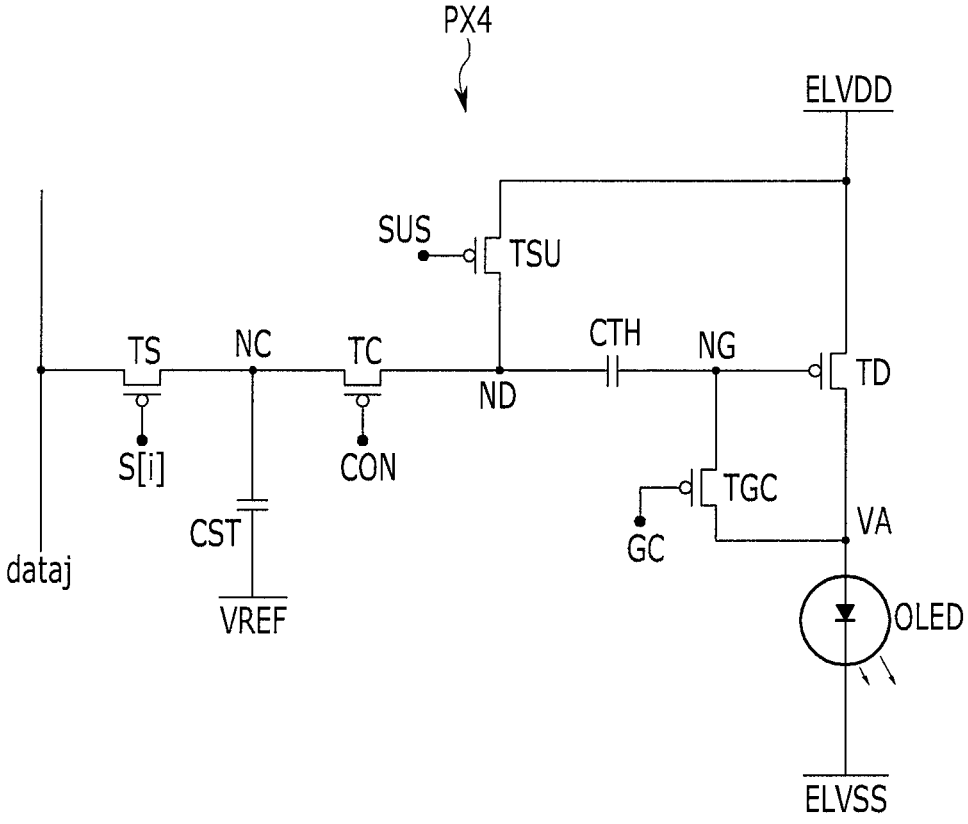
FIG. 11 is a view of a fourth pixel according to an exemplary embodiment of the present invention.

FIG. 11 is a view of the fourth pixel PX4.

In the fourth pixel PX4, different from the first pixel PX1, the first operation control transistor TSU is connected between the driving voltage ELVDD and the node ND, and the storage capacitor CST is connected between the node NC and the reference voltage VREF. The remaining structure is the same as that of the first pixel PX1 such that the detailed description is omitted.

The operation of the fourth pixel PX4 is described with reference to the driving waveform of the display device according to an exemplary embodiment of the present invention applied to the fourth pixel PX4.

Figure 12:
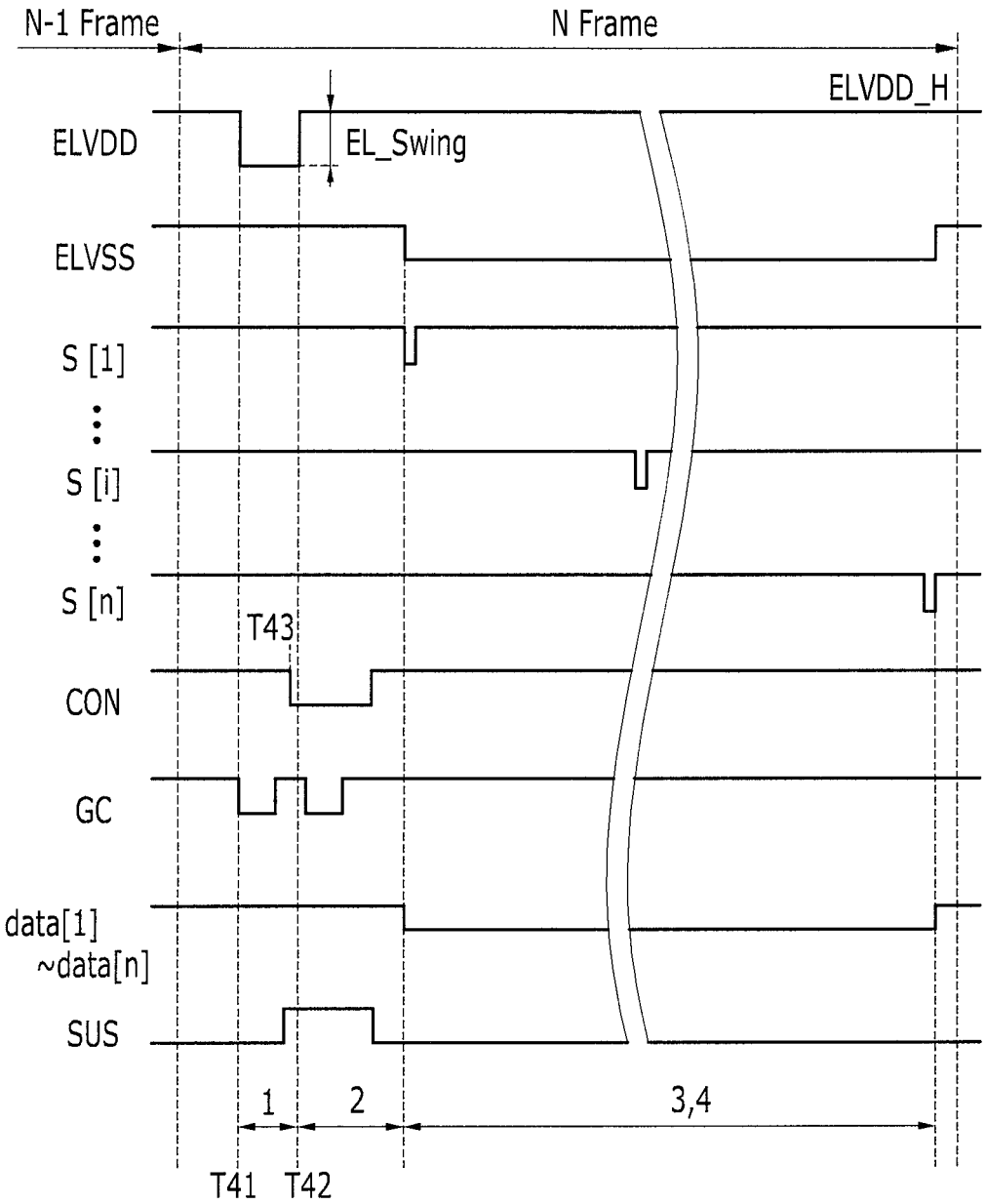
FIG. 12 is a view of a driving waveform of a display device according to an exemplary embodiment of the present invention applied to the fourth pixel.

FIG. 12 is a view of a driving waveform of a display device according to an exemplary embodiment of the present invention applied to the fourth pixel PX4.

The driving voltage ELVDD is changed from the high level to the low level at the view point T41 of the reset period 1. The first operation control transistor TSU is in the turn-on state, and the driving voltage ELVDD is the low level at the view point T41 such that the voltage of the node ND becomes the low level. The compensation control signal GC becomes the low level at the view point T41 such that the compensation control transistor TGC is turned on such that the anode of the organic light emitting diode OLED is connected to the node NG. At this time, the driving transistor TD is also turned on by the diode-connection.

The node NG is connected to the driving voltage ELVDD through the driving transistor TD, and the voltage of the node NG is decreased by the driving voltage ELVDD of the low level. The anode voltage VA is decreased by the driving voltage ELVDD of the low level and is reset.

Before the second operation control transistor TC is turned on such that the voltage stored to the storage capacitor CST is transmitted to the node ND, the operation which the first operation control transistor TSU is turned off is the same as that of the first pixel PX1.

As shown in FIG. 6, the storage capacitor CST of the first pixel PX1 is connected to the driving voltage ELVDD such that the operation in which the voltage of the node NC is decreased by the swing voltage EL_Swing of the driving voltage ELVDD at the view point T12 is generated. However, the storage capacitor CST of the fourth pixel PX4 is connected to the reference voltage VREF such that the operation in which the voltage of the node NC is decreased at the view point T41 is not generated in the fourth pixel PX4. That is, 'VC' is 'VDATA−EL_Swing' in the above Equation 1, however 'VC' is the same as 'VDATA' in the fourth pixel PX4.

The operation of the fourth pixel PX4 in the compensation period 2 and the scan period 3 is the same as that of the first pixel PX such that the detailed description is omitted.

As shown in FIG. 6, the voltage of the node ND of the first pixel PX1 is increased by 'a*EL_Swing' by the increase of the driving voltage ELVDD at the view point of the compensation period 2. However, the storage capacitor CST of the fourth pixel PX4 is connected to the reference voltage VREF such that the operation in which the voltage of the node ND is increased at the view point T42 is not generated in the fourth pixel PX4. That is, the voltage of the node ND of the fourth pixel PX4 at the view point T42 is the same as the voltage (hereinafter indicated by 'VDT5') applied to the node ND at the view point T43 at which the second operation control transistor TC is turned on.

The driving voltage ELVSS becomes the low level, and the driving voltage ELVDD is connected to the node ND at the light emitting period 4 such that the gate electrode of the driving transistor TD, that is, the voltage of the node NG, is reflected with the voltage variation of the node ND as in Equation 14.

$$VG=ELVDD_H+VTH+(ELVDD_H-VDT_F2) \quad \text{Equation 14}$$

At this time, 'ELVDD_H−VDT_F2' is the voltage variation of the node ND, and 'VDT_F2' as the final voltage of the node ND is the voltage (VDT_F2=VDT5+b*EL_var) of which the voltage increasing amount 'b*EL_var' of the node ND by the voltage increasing of the node NG is added to 'VDT5' among the compensation operation 2, differently from 'VDT_F' of Equation 4.

The driving voltage ELVSS is the low level during the light emitting period 4 such that the driving current flows to the organic light emitting diode OLED. At this time, the driving current IOLED is represented as Equation 15.

$$\begin{aligned} IOLED &= k(VGS-VTH)\text{^}2 \quad \text{Equation 15} \\ &= k\{(\text{ELVDD_H}+VTH+\text{ELVDD_H}-\text{VDT_F2})- \\ &\quad \text{ELVDD_H}-VTH\}\text{^}2 \\ &= k(\text{ELVDD_H}-\text{VDT_F2})\text{^}2 \end{aligned}$$

At this time, k is the parameter determined according to the characteristics of the driving transistor TD.

By the same reason as for the second pixel PX2, the driving current IOLED of the fourth pixel PX4 is affected by the voltage drop of the driving voltage ELVDD.

As described above, the driving current IOLED of the fourth pixel PX4 is not the influenced by the voltage drop of the driving voltage ELVDD and the threshold voltage VTH.

Next, a pixel implemented with the reset operation 1 will be described with reference to FIG. 13 to FIG. 15.

Figure 13:
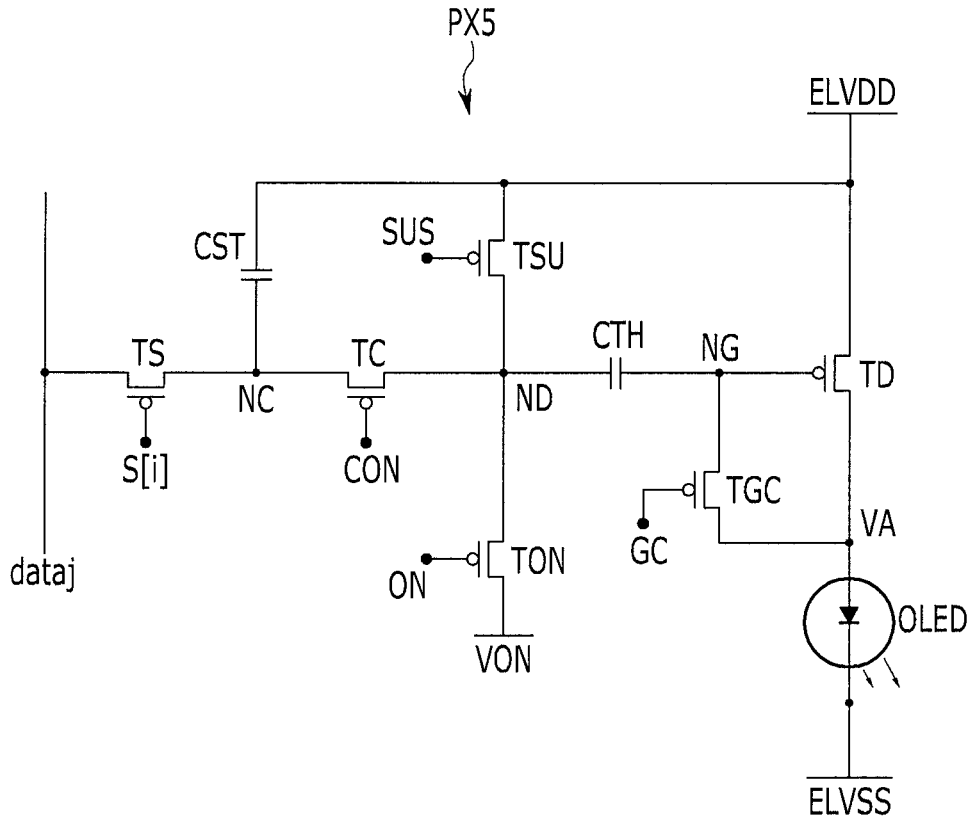
FIG. 13 is a view of a fifth pixel according to an exemplary embodiment of the present invention.

FIG. 13 is a view of a fifth pixel PX5 according to an exemplary embodiment of the present invention.

As shown in FIG. 13, the fifth pixel PX5 further includes the third operation control transistor TON connected to the node ND, compared with the second pixel PX2.

The third operation control transistor TON includes the gate electrode transmitted with the third operation control signal ON, the source electrode connected to the node ND, and the drain electrode connected to the control voltage VON. The control voltage VON is determined as the level to reset the node ND and the node NG in the reset period 1.

In the first to fourth pixels PX1-PX4 described above, the reset operation during the reset period 1 is executed through the first operation control transistor TSU. In the first to the fourth pixels PX1-PX4, the first operation control signal SUS is increased to the high level before the finish of the reset period 1 such that the first operation control transistor TSU is turned off.

However, in the fifth pixel PX, the reset operation during the reset period 1 is executed through the third operation control transistor TON. For this, the first operation control transistor TSU is turned off at the view point where the third operation control transistor TON is turned on among the reset period 1.

Except for this point, the operation is the same as the operation of the above second pixel PX2.

Next, the operation of the fifth pixel PX5 is described with reference to FIG. 14.

Figure 14:
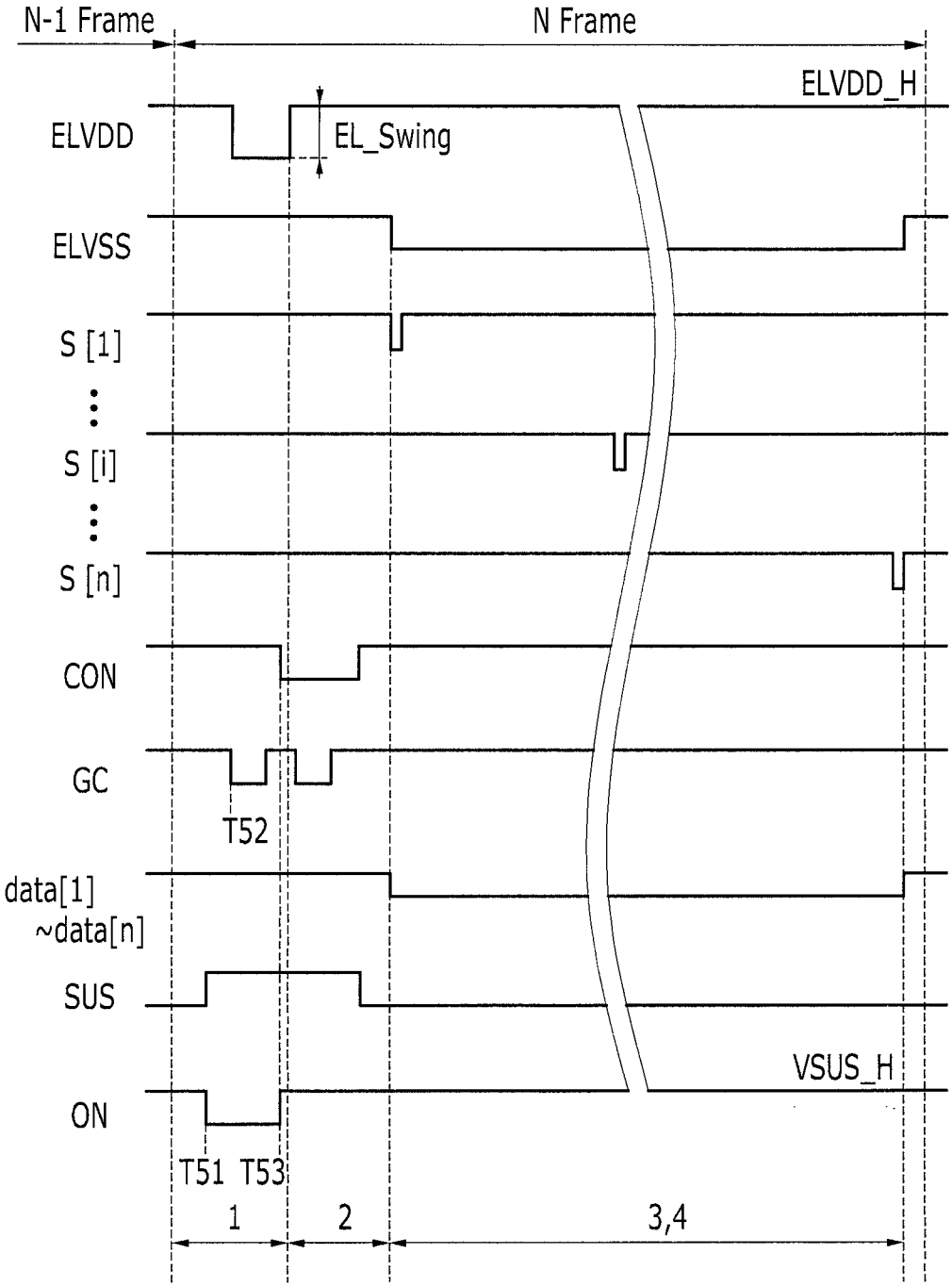
FIG. 14 is a view of a driving waveform of a display device according to an exemplary embodiment of the present invention applied to the fifth pixel.

FIG. 14 is a view of a driving waveform of a display device according to an exemplary embodiment of the present invention applied to the fifth pixel PX5.

The third operation control signal ON becomes the low level at the view point T51 of the reset period 1 such that the third operation control transistor TON is turned on, and the first operation control signal SUS becomes the high level such that the first operation control transistor TSU is turned off. The control voltage ON is connected to the node ND through the third operation control transistor TON. The node ND and the node NG are coupled by the capacitor CTH such that the voltage of the node ND is decreased by the control voltage ON and the voltage of the node NG is decreased therewith. This is the same as the above-described initialization operation.

The compensation control signal GC becomes the low level at the view point T52 such that the compensation control transistor TGC is turned on, and thereby the anode of the organic light emitting diode OLED is connected to the node NG. Also, the driving transistor TD is diode-connected and turned on. The node NG is connected to the driving voltage ELVDD through the driving transistor TD, and the voltage of the node NG is decreased by the driving voltage ELVDD of the low level. The anode voltage VA is decreased by the driving voltage ELVDD of the low level and is reset.

At the view point T53, the second operation control transistor TC is turned on such that the voltage stored to the storage capacitor CST is transmitted to the node ND, and the third operation control transistor TON is turned off.

The operation of the fifth pixel PX5 in the compensation period 2, the scan period 3, and the light emitting period 4 is the same as the operation of the second pixel PX such that the detailed description is omitted.

The fifth pixel PX5 may apply the control voltage VON for the reset operation to the node ND during the reset period 1. The fifth pixel PX is one example of the constitution to enhance the reset operation to the second pixel PX.

However, the present invention is not limited thereto, and it may be applied to the first, third, and fourth pixels PX1, PX3, and PX4.

Figure 15:
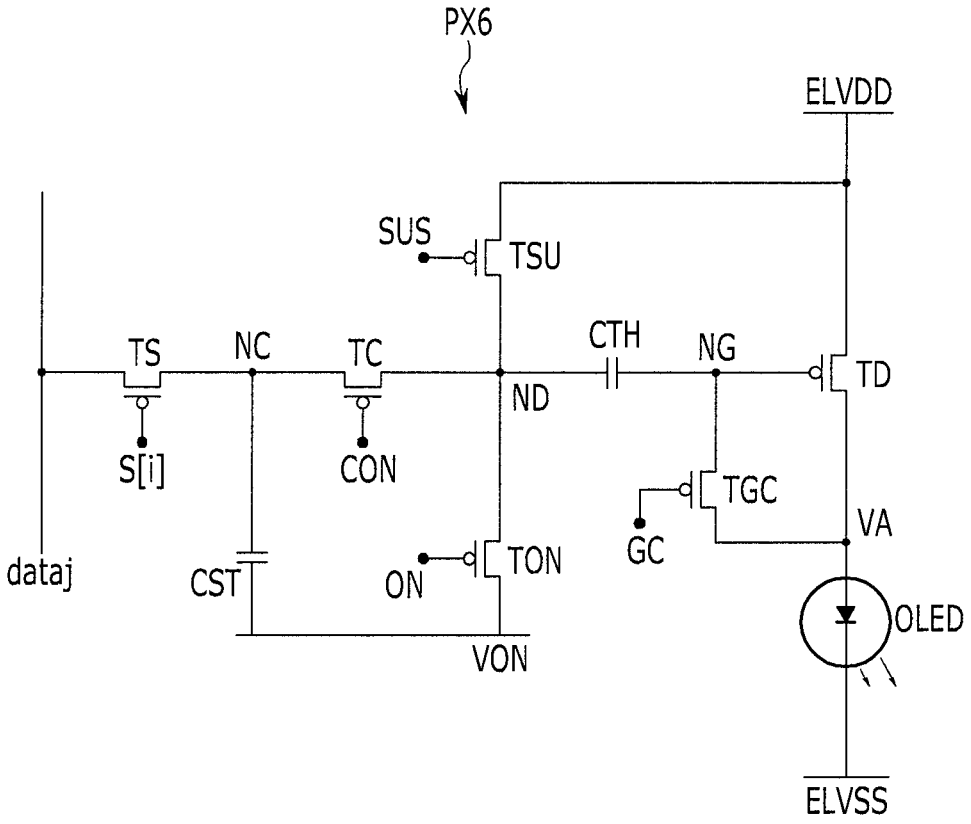
FIG. 15 is a view of a sixth pixel according to an exemplary embodiment of the present invention.

FIG. 15 is a view of a sixth pixel PX6 according to an exemplary embodiment of the present invention.

As shown in FIG. 15, compared with the fourth pixel PX4, the sixth pixel PX6 further includes the third operation control transistor TON connected to the node ND, and the storage capacitor CST is connected to the control voltage VON instead of the reference voltage VREF.

As described with reference to FIG. 14, only the operation of the reset period 1 is different, and the operation of the compensation period 2, the scan period 3, and the light emitting period 4 is the same as that of the fourth pixel PX4.

The pixel and the driving waveform thereof of the display device in which the scan period and the light emitting period are temporally overlapped has been described.

The concurrent or simultaneous light emitting driving method according to an exemplary embodiment of the present invention is further appropriate to display the stereoscopic image compared with the conventional art.

Figure 16:
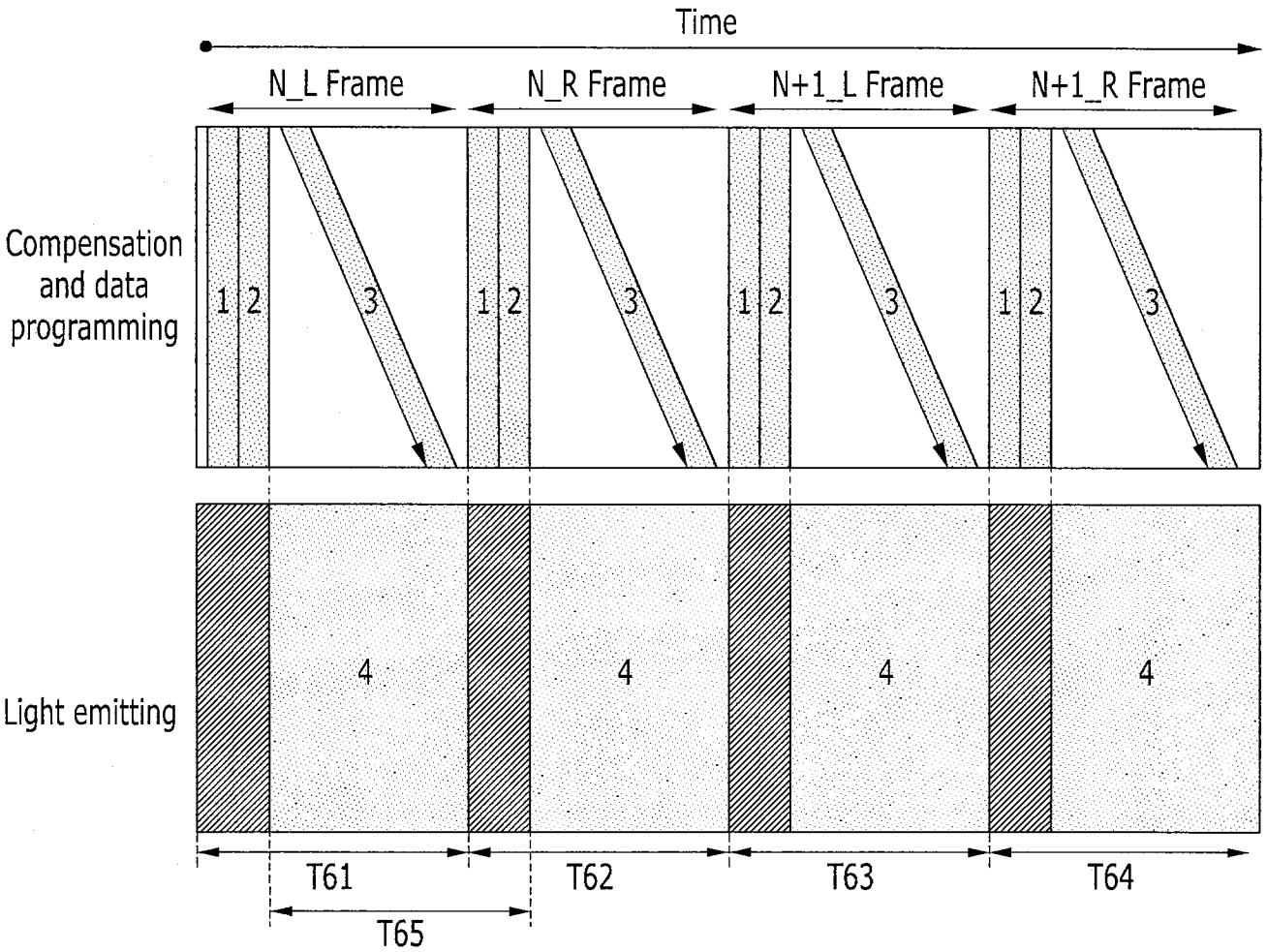
FIG. 16 is a view of a case that a stereoscopic image is displayed according to a concurrent or simultaneous light emitting driving method according to an exemplary embodiment of the present invention.

FIG. 16 is a view of a case in which a stereoscopic image is displayed according to a concurrent or simultaneous light emitting driving method according to an exemplary embodiment of the present invention.

The display device displays a left-eye image and a right-eye image to realize a stereoscopic image. There is a method using a shutter glasses among methods for displaying the left-eye image and the right-eye image. The left eye lens of the shutter glasses is opened during a period that the left-eye image is displayed, and the right eye lens is closed during this period. The right eye lens of the shutter glasses is opened during the period that the right-eye image is displayed, and the left eye lens is closed during this period.

FIG. 16 shows a method in which the display device displays the left-eye image and the right-eye image according to the shutter glasses method. As shown in FIG. 16, each frame includes the reset period 1, the compensation period 2, the scan period 3, and the light emitting period 4.

In FIG. 16, the frame in which a plurality of data signals (hereinafter referred to as a left eye image data signal) representing the left-eye image are respectively programmed to a plurality of pixels, is indicated by a reference numeral "L", and the frame in which a plurality of data signals (hereinafter referred to as a right eye image data signal) representing the right-eye image are respectively programmed to a plurality of pixels, is indicated by a reference numeral "R".

The waveforms of the driving voltage, the scan signal, the compensation control signal, and the operation control signal of the reset period 1, the compensation period 2, the scan period 3, and the light emitting period 4 are the same as the waveforms shown in FIGS. 6, 8, 10, 12, and 14 according to the pixel (one among PX1-PX6). The description for each period is omitted.

The left eye image data signal of the N_L frame is transmitted to a plurality of pixels during the scan period 3 of the period T61. During the scan period 3, the left eye image data signals corresponding to the plurality of pixels are programmed. At this time, another plurality of pixels emit light according to the right eye image data signals programmed at the scan period 3 of the (N−1)_R frame during the light emitting period 4 of the period T61.

The right eye image data signal of the N_R frame is transmitted to a plurality of pixels at the scan period 3 of the period T62. The right eye image data signal respectively corresponding to the plurality of pixels is programmed during the scan period 3. At this time, another plurality of pixels emit light according to the left eye image data signal programmed at the scan period 3 of the N_L frame during the light emitting period 4 of the period T62.

The left eye image data signal of the (N+1)_L frame is transmitted to a plurality of pixels at the scan period 3 of the period T63. The eye image data signal respectively corresponding to the plurality of pixels is programmed during the scan period 3. At this time, another plurality of pixels emit light according to the right eye image data signal programmed at the scan period 3 of the N_R frame during the light emitting period 4 of the period T63.

The right eye image data signal of the (N+1)_R frame is transmitted to a plurality of pixels at the scan period 3 of the period T64. The right eye image data signal respectively corresponding to the plurality of pixels is programmed during the scan period 3. Here, another plurality of pixels emit light according to the left eye image data signal programmed of the scan period 3 of the (N+1)_L frame during the light emitting period 4 of the period T64.

By this method, the light due to the right-eye image is concurrently or simultaneously emitted during the period in which the left-eye image is programmed, and the light due to the left-eye image is simultaneously emitted during the period in which the right-eye image is programmed. Thus, a sufficient light emitting period may be obtained, and thereby the image quality of the stereoscopic image is improved.

The scan period 3 and the light emitting period 4 are included in the same period such that the interval T31 between the light emitting period 4 of each frame may be set up regardless of the scan period. Here, the interval between the light emitting period 4 may be set up as an interval that is desired for the response speed of the liquid crystal of the shutter glasses.

In a case of the conventional art in which the scan period 3 and the light emitting period 4 are not included in the same period, the light emitting period 4 is disposed after the scan period 3 such that the temporal margin with which the light emitting period 4 may be set up among the period of one frame is small. According to an exemplary embodiment of the present invention, the light emitting period 4 may be set up in the period except for (excluding) the reset period and the compensation period among the period of one frame, or in the period except for the initialization period, the reset period, and the compensation period of one frame. Accordingly, the temporal margin capable of setting up the light emitting period 4 is increased compared with the conventional art, and thereby the interval between the light emitting periods 4 may be set while considering the liquid crystal response speed of the shutter glasses.

For example, the interval T31 between the light emitting periods 4 may be set while considering the time that the right eye lens (or the left eye lens) of the shutter glasses is completely opened from the time that the light emitting of the left-eye image (or the right-eye image) is finished.

Next, a constitution of a display device according to an exemplary embodiment of the present invention will be described with reference to FIG. 17.

Figure 17:
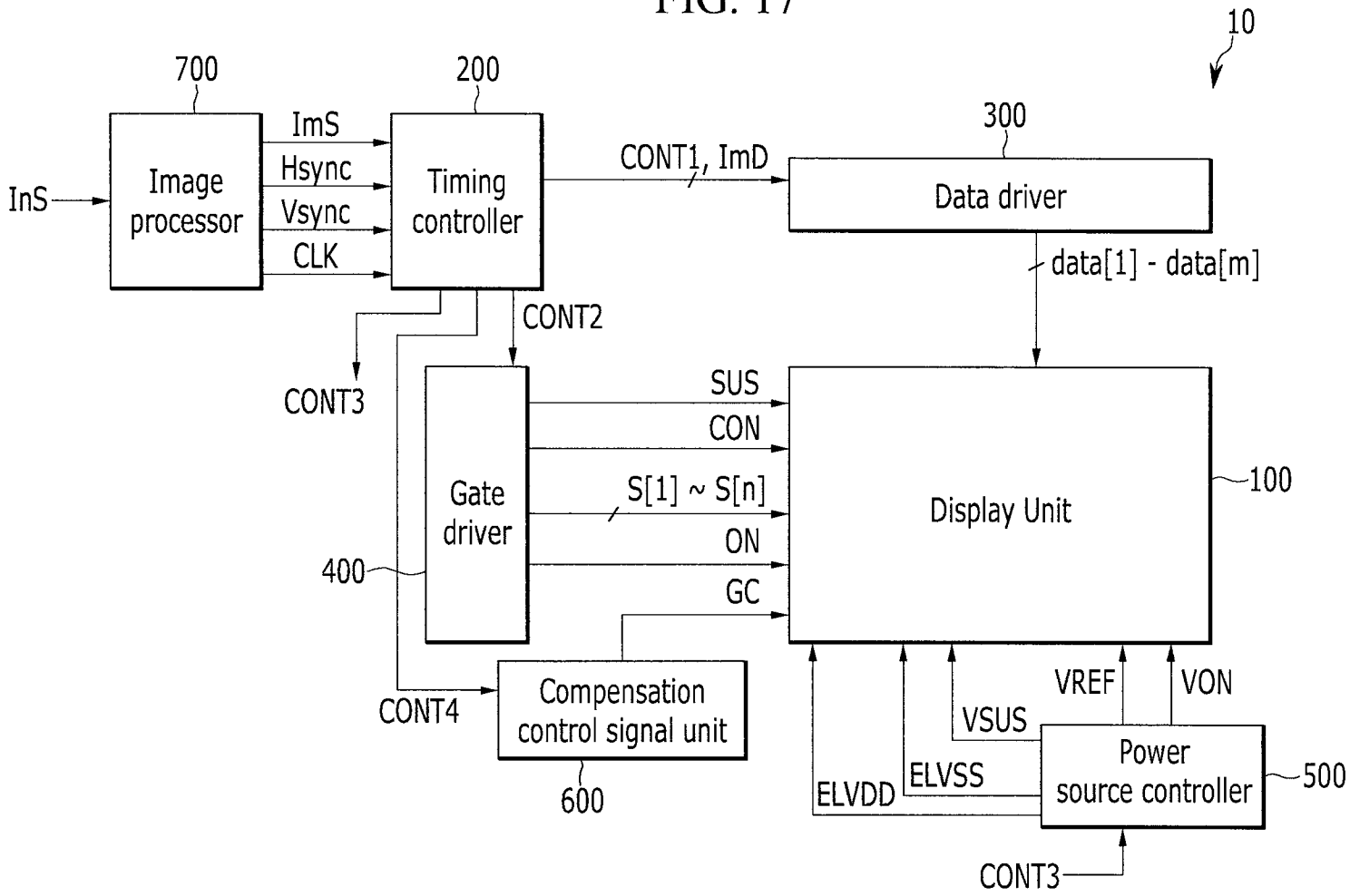
FIG. 17 is a view of a display device according to an exemplary embodiment of the present invention.

FIG. 17 is a view of a display device according to an exemplary embodiment of the present invention.

As shown in FIG. 17, the display device 10 includes an image processing unit 700, a timing controller 200, a data driver 300, a scan driver 400, a power source controller 500, a compensation control signal unit 600, and a display unit 100.

The image processing unit 700 generates a video signal ImS and a synchronization signal from an input signal InS. The synchronization signal includes a horizontal synchronization signal Hsync, a vertical synchronization signal Vsync, and a main clock signal CLK.

The image processing unit 700 divides the left-eye video signal (representing the left-eye image) and the right-eye video signal (representing the right-eye image) as a frame unit when a signal (hereinafter an image source signal), representing the image included in the input signal InS, is the signal representing the stereoscopic image. The image processing unit 700 arranges the left-eye video signal and the right-eye video signal according to the vertical synchronization and the horizontal synchronization to generate the video signal ImS.

When the image source signal is a signal representing a plane image, the image processing unit 700 divides the image source signal as the frame unit and arranges the image source signal according to the vertical synchronization and the horizontal synchronization to generate the video signal ImS.

The main clock signal CLK may be a clock signal having a basic frequency included in the image source signal, or may be one of clock signals appropriately generated according to necessity of the image processing unit 700.

The timing controller 200 generates first to fourth driving control signals CONT1-CONT4 and the image data signal ImD according to the video signal ImS, the vertical synchronization signal Vsync, the horizontal synchronization signal Hsync, and the main clock signal CLK.

The timing controller 200 divides the video signal ImS as the frame unit according to the vertical synchronization signal Vsync and divides the video signal ImS as the scan line unit according to the horizontal synchronization signal Hsync to generate the image data signal ImD, and transmit it to the data driver 300 along with the first driving control signal CONT1.

The data driver 300 samples and holds the image data signal ImD input according to the first driving control signal CONT1, and respectively transmits a plurality of data signals data[1]-data[m] to a plurality of data lines.

The scan driver 400 generates a plurality of scan signals S[1]-S[n], the first operation control signal SUS, and the second operation control signal CON according to the second driving control signal CONT2, and transmits them to the corresponding scan line during the initialization period INIT, the reset period 1, the compensation period 2, the scan period 3, and the light emitting period 4 of each frame.

When the fifth and sixth pixels PX5 and PX6 are applied to the display unit 100, the scan driver 400 further generates a third operation control signal ON. At this time, the second driving control signal CONT further includes information for the third operation control signal ON.

The power source controller 500 determines the levels of the driving voltages ELVDD and ELVSS and the assistance voltage VSUS during the reset period 1, the compensation period 2, the scan period 3, and the light emitting period 4 according to the third driving control signal CONT3, and supplies them to the power line.

When the fourth pixel PX4 is applied to the display unit 100, the power source controller 500 may further generate the reference voltage VREF and supply it to the display unit 100. Also, when the fifth and sixth pixels PX5 and PX6 are applied to the display unit 100, the power source controller 500 may further generate the control voltage VON and supply it to the display unit 100.

The compensation control signal unit 600 determines the level of the compensation control signal GC during the reset period 1, the compensation period 2, the scan period 3, and the light emitting period 4 according to the fourth driving control signal CONT4, and supplies them to the control signal line.

The display unit 100 was described above with reference to FIG. 4.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS reset period 1, compensation period 2, scan period 3, light emitting period 4 scan lines S1-Sn, data lines data1-datam, first voltage line 101 second voltage line 102, compensation control line 103, first operation control line 104 second operation control line 105, assistance voltage line 106, driving transistor TD switching transistor TS, first operation control transistor TSU second operation control transistor TC, compensation transistor TGC third operation control transistor TON, storage capacitor CST, compensation capacitor CTH organic light emitting diode OLED, driving voltage ELVDD, ELVSS, control voltage VON pixel PX1, PX2, PX3, PX4, PX5, PX6, image processing unit 700 timing controller 200, data driver 300, scan driver 400 power source controller 500, compensation control signal unit 600, display unit 100, reference voltage VREF

What is claimed is:

1. A driving method of a display device including a plurality of pixels each including an organic light emitting diode (OLED), a driving transistor configured to be connected to a driving voltage and for supplying a driving current to the OLED, a compensation capacitor connected to a gate electrode of the driving transistor, and a storage capacitor electrically connected to or disconnected from the compensation capacitor, the method comprising:

a reset step in which a first voltage corresponding to a data voltage applied to the storage capacitor is transmitted to the compensation capacitor after an anode voltage of the OLED is discharged and reset;

a compensation step in which a voltage corresponding to a threshold voltage of the driving transistor is transmitted to the compensation capacitor;

a data voltage storing step of a current frame in which a data voltage of the current frame is stored according to a corresponding data signal to the storage capacitor; and a light emitting step of the current frame in which the OLED emits light according to the driving current flowing to the driving transistor by the voltage stored to the storage capacitor of a previous frame, wherein the light emitting steps of the plurality of pixels are concurrently generated, and the data voltage storing step of one of the plurality of pixels and a light emitting portion of the light emitting step of a same one of the plurality of pixels are temporally overlapped, and wherein the storage capacitor and the compensation capacitor are configured to be disconnected from each other during the light emitting step.

2. The driving method of claim 1, wherein the reset step includes:

a step in which the data voltage is shifted by a first swing of the driving voltage to generate a first voltage; and a step in which the compensation capacitor and the storage capacitor are connected in series such that the first voltage is divided by the compensation capacitor and the storage capacitor.

3. The driving method of claim 2, wherein the compensation step includes:

changing the voltage distributed to the compensation capacitor and the storage capacitor by a second swing of the driving voltage, and diode-connecting the driving transistor such that the voltage distributed to the compensation capacitor and the storage capacitor is changed.

4. The driving method of claim 3, wherein the reset step further includes:

an initialization step in which an assistance voltage at a first level is applied to a node at which the compensation capacitor and the storage capacitor are connected.

5. The driving method of claim 4, wherein the light emitting step includes a step in which the voltage stored to the compensation capacitor is changed by the assistance voltage at a second level.

6. The driving method of claim 2, wherein the reset step further includes a step in which the driving voltage is connected to one terminal of the compensation capacitor, and an anode of the OLED is connected to another terminal of the compensation capacitor.

7. The driving method of claim 6, wherein the compensation step includes:

a step in which the voltage distributed to the compensation capacitor and the storage capacitor is changed by a second swing of the driving voltage; and a step in which the driving transistor is diode-connected such that the voltage distributed to the compensation capacitor and the storage capacitor is changed.

8. The driving method of claim 7, wherein the light emitting step includes a step in which the voltage stored to the compensation capacitor is changed by the voltage level of the driving voltage after the second swing of the driving voltage.

9. The driving method of claim 1, wherein the reset step includes a step in which an assistance voltage is connected to one terminal of the compensation capacitor;

a step in which the data voltage is shifted by a first swing of the assistance voltage connected to the storage capacitor such that a first voltage is generated; and a step in which an anode of the OLED and another terminal of the compensation capacitor are connected after the first swing of the assistance voltage.

10. The driving method of claim 9, wherein the reset step further includes a step in which the compensation capacitor and the storage capacitor are connected in series such that the first voltage is distributed to the compensation capacitor and the storage capacitor.

11. The driving method of claim 10, wherein the compensation step includes a step in which the voltage distributed to the compensation capacitor and the storage capacitor is changed by a second swing of the assistance voltage, and a step in which the driving transistor is diode-connected such that the voltage distributed to the compensation capacitor and the storage capacitor is changed.

12. The driving method of claim 11, wherein the light emitting step includes a step in which the voltage stored to the compensation capacitor is changed by the voltage level of the assistance voltage after the second swing of the assistance voltage.

13. The driving method of claim 1, wherein the reset step includes a step in which the driving voltage is connected to one terminal of the compensation capacitor, and an anode of the OLED is connected to another terminal of the compensation capacitor.

14. The driving method of claim 13, wherein the reset step further includes a step in which the compensation capacitor and the storage capacitor are connected in series such that a first voltage is distributed to the compensation capacitor and the storage capacitor, and the first voltage is the same as the data voltage.

15. The driving method of claim 14, wherein the compensation step includes a step in which the driving transistor is diode-connected such that the voltage distributed to the compensation capacitor and the storage capacitor is changed.

16. The method driving method of claim 15, wherein the light emitting step includes a step in which that the driving voltage is connected to the compensation capacitor such that the voltage stored to the compensation capacitor is changed.

17. The driving method of claim 1, wherein the reset step includes:

a step in which one terminal of the compensation capacitor is applied with a control voltage, and another terminal of the compensation capacitor is connected to an anode of the OLED;

a step in which the data voltage is shifted by a first swing of the driving voltage such that the first voltage is generated; and a step in which the control voltage is disconnected from the one terminal of the compensation capacitor, and the compensation capacitor and the storage capacitor are connected in series such that the first voltage is distributed to the compensation capacitor and the storage capacitor.

18. The driving method of claim 1, wherein the reset step includes:

a step in which a control voltage is applied to one terminal of the compensation capacitor, and another terminal of the compensation capacitor and an anode of the OLED are connected; and a step in which the control voltage is blocked from the one terminal of the compensation capacitor, and the compensation capacitor and the storage capacitor are connected in series such that a first voltage is distributed to the compensation capacitor and the storage capacitor, and wherein the first voltage is the same as the data voltage.

19. The driving method of claim 1, wherein the display device further includes a different driving voltage connected to a cathode of the OLED, and the voltage level of the different driving voltage during the reset step and the compensation step is different than that during the light emitting step.

20. The driving method of claim 1, wherein the reset step includes a step in which a source of the anode voltage is connected to a source of the driving voltage by turning the driving transistor on, and the anode voltage is decreased by a low level of the driving voltage.

21. A driving method of a display device including a plurality of pixels, each including a driving transistor, a compensation capacitor, and a storage capacitor, the method comprising:

programming first frame data to the storage capacitor of each of the plurality of pixels during a first data voltage storing period;

programming second frame data to the storage capacitor of each of the plurality of pixels during a second data voltage storing period; and transmitting a voltage, corresponding to a voltage of the first frame data programmed to the storage capacitor, to the compensation capacitor and emitting light through the plurality of pixels by a driving current flowing in the driving transistor according to voltage transmitted to the compensation capacitor during a first light emitting period, wherein the second data voltage storing period of one of the plurality of pixels and a light emitting portion of the first light emitting period of a same one of the plurality of pixels are temporally overlapped, and wherein the storage capacitor and the compensation capacitor are configured to be disconnected from each other during the first light emitting period.

22. The driving method of claim 21, wherein the first frame data is first view point data, and the second frame data is second view point data different from the first view point data.

23. A pixel comprising:

an organic light emitting diode (OLED);

a driving transistor configured to be electrically connected to a first driving voltage and to supply a driving current to the OLED;

a compensation capacitor including one electrode connected to a gate electrode of the driving transistor;

a first operation control transistor including one electrode connected to another electrode of the compensation capacitor and configured to be controlled by a first operation control signal;

a second operation control transistor including one electrode connected to the other electrode of the compensation capacitor and configured to be controlled by a second operation control signal;

a storage capacitor including one electrode connected to another electrode of the second operation control transistor; and a compensation transistor connected to the driving transistor, wherein the first operation control transistor is configured such that when it is turned on, the driving current is determined according to the voltage of the compensation capacitor during a period in which the second operation control transistor is turned off, and a data voltage according to a corresponding data signal is stored to the storage capacitor, wherein the one electrode of the first operation control transistor and the one electrode of the second operation control transistor are commonly connected to the other electrode of the compensation capacitor at a common node, and wherein the compensation transistor is configured to diode-couple the driving transistor during a period in which the first operation control transistor is turned on, and during a period in which the first operation control transistor is turned off.

24. The pixel of claim 23, further comprising:

a switching transistor including one electrode connected to the one electrode of the storage capacitor, and another electrode configured to be input with a corresponding data signal and controlled by a scan signal.

25. The pixel of claim 23, wherein the compensation transistor is connected between the gate electrode and a drain electrode of the driving transistor.

26. The pixel of claim 25, wherein the pixel is configured to provide the first driving voltage to be at a low level during a period in which the first operation control transistor and the compensation transistor are turned on during a reset period.

27. The pixel of claim 25, wherein the pixel is configured to provide the first driving voltage to be at a high level during a period in which the second operation control transistor and the compensation transistor are turned on during a compensation period.

28. The pixel of claim 25, wherein another electrode of the first operation control transistor is configured to be connected to an assistance voltage, wherein the pixel is configured to provide the assistance voltage to be at a first level during a first period in which the first operation control transistor and the compensation transistor are concurrently turned on, and to provide the assistance voltage to be swung to a second level different from the first level after the second operation control transistor is turned on after the first period.

29. The pixel of claim 28, wherein the pixel is configured to provide the first driving voltage to be at a low level during the first period and to provide the first driving voltage to be at a high level after the second operation control transistor is turned on, and an cathode of the OLED is configured to be connected to a second driving voltage, and the pixel is configured to provide the second driving voltage to be at a low level after the second operation control transistor is turned off.

30. The pixel of claim 25, wherein another electrode of the first operation control transistor is configured to be connected to the first driving voltage, the pixel is configured to provide the first driving voltage to be at a low level during a first period in which the first operation control transistor and the compensation transistor are concurrently turned on, and after the first period, the pixel is configured to provide the first driving voltage to be at a high level after the second operation control transistor is turned on, a cathode of the OLED is connected to a second driving voltage, and the pixel is configured to provide the second driving voltage to be at a low level after the second operation control transistor is turned off.

31. The pixel of claim 25, wherein another electrode of the first operation control transistor and another electrode of the storage capacitor are both configured to be connected to an assistance voltage, the pixel is configured to provide the assistance voltage to be at a first level during a first period in which the first operation control transistor and the compensation transistor are currently turned on, and after the first period, the pixel is configured to provide the assistance voltage to be at a second level different from the first level after the second operation control transistor is turned on.

32. The pixel of claim 31, wherein a cathode of the OLED is configured to be connected to a second driving voltage, wherein after a first period, the pixel is configured to provide the first driving voltage to be at a high level after the second operation control transistor is turned on, and the pixel is configured to provide the second driving voltage to be at a low level after the second operation control transistor is turned off, and the first operation control transistor is again turned on.

33. The pixel of claim 25, wherein another electrode of the storage capacitor is configured to be connected to a reference voltage, and a cathode of the OLED is configured to be connected to a second driving voltage, wherein another electrode of the first operation control transistor is configured to be connected to the first driving voltage, the pixel is configured to provide the first driving voltage to be at a low level during a first period in which the first operation control transistor and the compensation transistor are concurrently turned on, and after the first period, the pixel is configured to provide the first driving voltage to be at a high level after the second operation control transistor is turned on, and the pixel is configured to provide the second driving voltage to be at a low level after the second operation control transistor is turned off.

34. The pixel of claim 25, further comprising:

a third operation control transistor comprising one electrode connected to the one electrode of the first operation control transistor and configured to be operated by a third operation control signal, and another electrode of the third operation control transistor is configured to be connected to a control voltage, wherein the one electrode of the first operation control transistor is configured to be connected to the first driving voltage, the pixel is configured to provide the control voltage and the first driving voltage to be at a low level during a first period in which the third operation control transistor and the compensation transistor are concurrently turned on, and after the first period, and the pixel is configured to provide a first control voltage and the first driving voltage to be at a high level after the second operation control transistor is turned on.

35. The pixel of claim 34, wherein a cathode of the OLED is configured to be connected to a second driving voltage, and the pixel is configured to provide the second driving voltage to become a low level after the second operation control transistor is turned off.

36. The pixel of claim 25, further comprising:

a third operation control transistor comprising one electrode connected to the one electrode of the first operation control transistor and configured to be operated by a third operation control signal, another electrode of the third operation control transistor is configured to be connected to a control voltage, and a cathode of the OLED is configured to be connected to a second driving voltage, wherein another electrode of the storage capacitor is configured to be connected to the control voltage, another electrode of the first operation control transistor is configured to be connected to the first driving voltage, the pixel is configured to provide the control voltage and the first driving voltage to be a low level during a first period in which the third operation control transistor and the compensation transistor are concurrently turned on, and after the first period, the pixel is configured to provide the control voltage and the first driving voltage to be at a high level after the second operation control transistor is turned on, and the pixel is configured to provide the second driving voltage to be at a low level after the second operation control transistor is turned off.

37. A display device comprising:

a plurality of data lines for transmitting a plurality of data signals;

a plurality of scan lines for transmitting a plurality of scan signals;

a first operation control line and a second operation control line for transmitting a first operation control signal and a second operation control signal;

a first voltage line for transmitting a first driving voltage and a second voltage line for transmitting a second driving voltage; and a plurality of pixels each connected to a corresponding data line of the data lines, a corresponding scan line of the scan lines, the first operation control line, the second operation control line, the first voltage line, and the second voltage line, wherein each of the pixels includes:

an organic light emitting diode (OLED) including a cathode connected to the second voltage line;

a driving transistor connected to the first voltage line and for supplying a driving current to the OLED;

a compensation capacitor connected to a gate electrode of the driving transistor;

a first operation control transistor including one electrode connected to another electrode of the compensation capacitor and configured to be controlled by the first operation control signal transmitted to the first operation control line;

a second operation control transistor including one electrode connected to the other electrode of the compensation capacitor and configured to be controlled by the second operation control signal transmitted through the second operation control line;

a storage capacitor including one electrode connected to another electrode of the second operation control transistor; and a compensation transistor connected to the driving transistor, wherein the display device is configured to provide a scan period in which the storage capacitor is connected to the corresponding data line according to a scan signal of the scan signals transmitted through the corresponding scan line, and a light emitting period temporally overlapped with the scan period and in which the first operation control transistor is turned on and the second operation control transistor is turned off such that the driving transistor supplies the driving current according to a voltage stored to the compensation capacitor, wherein the one electrode of the first operation control transistor and the one electrode of the second operation control transistor are commonly connected to the other electrode of the compensation capacitor at a common node, and wherein the compensation transistor is configured to diode-couple the driving transistor during a period in which the first operation control transistor is turned on, and during a period in which the first operation control transistor is turned off.

38. The display device of claim 37, wherein the display device further includes a plurality of compensation control lines for transmitting a compensation signal, and wherein the compensation transistor is connected to the gate electrode and a drain electrode of the driving transistor and configured to be operated according to the compensation signal.

39. The display device of claim 37, wherein the display device is configured to provide the second driving voltage to be at a low level only during the light emitting period.

* * * * *